US006491376B2

(12) United States Patent
Trauernicht et al.

(10) Patent No.: US 6,491,376 B2
(45) Date of Patent: Dec. 10, 2002

(54) CONTINUOUS INK JET PRINTHEAD WITH THIN MEMBRANE NOZZLE PLATE

(75) Inventors: David P. Trauernicht, Rochester, NY (US); Constantine N. Anagnostopoulos, Mendon, NY (US); James M. Chwalek, Pittsford, NY (US); Christopher N. Delametter, Rochester, NY (US); Gilbert A. Hawkins, Mendon, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 4 days.

(21) Appl. No.: 09/862,953

(22) Filed: May 22, 2001

(65) Prior Publication Data

US 2002/0113840 A1 Aug. 22, 2002

Related U.S. Application Data

(63) Continuation-in-part of application No. 09/792,114, filed on Feb. 22, 2001.

(51) Int. Cl.[7] ..... B41J 2/14; B41J 2/16; B41J 2/09

(52) U.S. Cl. ..... 347/47; 347/77

(58) Field of Search ..... 347/44, 47, 73, 347/74, 75, 76, 77

(56) References Cited

U.S. PATENT DOCUMENTS

| | | | | |
|---|---|---|---|---|
| 1,941,001 A | | 12/1933 | Hansell | 178/96 |
| 3,373,437 A | | 8/1967 | Sweet et al. | 347/74 |
| 3,416,153 A | | 12/1968 | Hertz et al. | 347/73 |
| 3,946,398 A | | 3/1976 | Kyser et al. | 347/70 |
| 4,346,387 A | | 8/1982 | Hertz | 347/75 |
| 5,417,897 A | | 5/1995 | Asakawa et al. | 264/400 |
| 5,880,759 A | | 3/1999 | Silvervrook | 347/55 |
| 6,079,821 A | | 6/2000 | Chwalek et al. | 347/82 |
| 6,089,698 A | | 7/2000 | Temple et al. | 347/47 |
| 6,203,145 B1 | * | 3/2001 | Jeanmaire et al. | 347/75 |
| 6,213,595 B1 | | 4/2001 | Anagnostopoulos et al. | 347/82 |
| 6,217,163 B1 | | 4/2001 | Anagnostopoulos et al. | 347/75 |

FOREIGN PATENT DOCUMENTS

GB 2007162 A 10/1978 ..... B41J/3/05

OTHER PUBLICATIONS

U S Patent Application 09/451,790, Trauernicht et al filed Dec. 1, 1999.
U S Patent Appli 09/470,638, Delametter et al filed Dec. 22, 1999.
U S Patent Appli 09/466,346, Jeanmaire et al filed Dec. 17, 1999 (now U.S. Patent 6,203,145).
U S Patent Appli 09/221,256, Anagnostopoulos et al, filed Dec. 28, 1998.
U S Patent Appli 09/221,342, Anagnostopoulos et al, filed Dec. 28, 1998.

* cited by examiner

*Primary Examiner*—John Barlow
*Assistant Examiner*—Juanita Stephens
(74) *Attorney, Agent, or Firm*—Norman Rushefsky

(57) ABSTRACT

A continuous ink jet printhead has a nozzle bore formed from a thin membrane that comprises an overhang from a relief portion of the substrate. The thin membrane of thickness t overhangs a relief portion of the substrate with a dimension OH. The nozzle bore has a respective diameter dimension D. The dimensions are characterized in that OH>=½ D; and wherein t<=0.33D.

50 Claims, 29 Drawing Sheets

CONTINUOUS INK JET PRINTHEAD WITH THIN MEMBRANE NOZZLE PLATE

CROSS REFERENCE TO RELATED APPLICATIONS

This application is a continuation-in-part of U.S. application Ser. No. 09/792,114, filed Feb. 22, 2001 in the names of Anagnostopoulos et al.

FIELD OF THE INVENTION

This invention generally relates to the field of digitally controlled printing devices, and in particular to liquid ink printheads in which a liquid drop is selected for printing by the asymmetrical application of heat to a jet of fluid.

BACKGROUND OF THE INVENTION

Ink jet printing has become recognized as a prominent contender in the digitally controlled, electronic printing arena because, e.g., of its non-impact, low noise characteristics and system simplicity. For these reasons, ink jet printers have achieved commercial success for home and office use and other areas.

Ink jet printing mechanisms can be categorized as either continuous (CIJ) or Drop-on-Demand (DOD). U.S. Pat. No. 3,946,398, which issued to Kyser et al. in 1970, discloses a DOD ink jet printer which applies a high voltage to a piezoelectric crystal, causing the crystal to bend, applying pressure on an ink reservoir and jetting drops on demand. Piezoelectric DOD printers have achieved commercial success at image resolutions greater than 720 dpi for home and office printers. However, piezoelectric printing mechanisms usually require compiles high voltage drive circuitry and bulky piezoelectric crystal arrays, which are advantageous in regard to number of nozzles per unit length of printhead, as well as the length of the printhead. Typically, piezoelectric printheads contain at most a few hundred nozzles.

Great Britain Patent No. 2,007,162, which issued to Endo et al. in 1979, discloses an electrothermal drop-on-demand ink jet printer that applies a power pulse to a heater which is in thermal contact with water based ink in a nozzle. A small quantity of ink rapidly evaporates, forming a bubble, which causes a drop of ink to be ejected from small apertures along an edge of a heater substrate. This technology is known as thermal ink jet or bubble jet.

Thermal ink jet printing typically requires that the heater generates an energy impulse enough to heat the ink to a temperature near 400° C. which causes a rapid formation of a bubble. The high temperatures needed with this device necessitate the use of special inks, complicates driver electronics, and precipitates deterioration of heater elements through cavitation and kogation. Kogation is the accumulation of ink combustion by-products that encrust the heater with debris. Such encrusted debris interferes with the thermal efficiency of the heater and thus shorten the operational life of the printhead. And, the high active power consumption of each heater prevents the manufacture of low cost, high speed and page wide printheads.

Continuous ink jet printing itself dates back to at least 1929. See U.S. Pat. No. 1,941,001 which issued to Hansell that year.

U.S. Pat. No. 3,373,437 which issued to Sweet et al. in March 1968, discloses an array of continuous ink jet nozzles wherein ink drops to be printed are selectively charged and deflected towards the recording medium. This technique is known as binary deflection continuous ink jet printing, and is used by several manufacturers, including Elmjet and Scitex.

U.S. Pat. No. 3,416,153, issued to Hertz et al. in December 1968. This patent discloses a method of achieving variable optical density of printed spots, in continuous ink jet printing. The electrostatic dispersion of a charged drop stream serves to modulate the number of droplets which pass-through a small aperture. This technique is used in ink jet printers manufactured by Iris.

U.S. Pat. No. 4,346,387, entitled METHOD AND APPARATUS FOR CONTROLLING THE ELECTRIC CHARGE ON DROPLETS AND INK JET RECORDER INCORPORATING THE SAME issued in the name of Carl H. Hertz on Aug. 24, 1982. This patent discloses a CIJ system for controlling the electrostatic charge on droplets. The droplets are formed by breaking up of a pressurized liquid stream, at a drop formation point located within an electrostatic charging tunnel, having an electrical field. Drop formation is effected at a point in the electrical field corresponding to whatever predetermined charge is desired. In addition to charging tunnels, deflection plates are used to actually deflect the drops. The Hertz system requires that the droplets produced by charged and then deflected into a gutter or onto the printing medium. The charging and deflection mechanisms are bulky and severely limit the number of nozzles per printhead.

Until recently, conventional continuous ink jet techniques all utilized, in one form or another, electrostatic charging tunnels that were placed close to the point where the drops are formed in the stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode.

Recently, a novel continuous ink jet printer system has been developed which renders the above-described electrostatic charging tunnels unnecessary. Additionally, it serves to better couple the functions of (1) droplet formation and (2) droplet deflection. That system is disclosed in the commonly assigned U.S. Pat. No. 6,079,821 entitled CONTINUOUS INK JET PRINTER WITH ASYMMETRIC HEATING DROP DEFLECTION filed in the names of James Chwalek, Dave Jeanmaire and Constantine Anagnostopoulos, the contents of which are incorporated herein by reference. This patent discloses an apparatus for controlling ink in a continuous ink jet printer. The apparatus comprises an ink delivery channel, a source of pressurized ink in communication with the ink delivery channel, and a nozzle having a bore which opens into the ink delivery channel, from which a continuous stream of ink flows. Periodic application of weak heat pulses to the stream by a heater causes the ink stream to break up into a plurality of droplets synchronously with the applied heat pulses and at a position spaced from the nozzle. The droplets are deflected by increased heat pulses from the heater (in the nozzle bore) which heater has a selectively actuated section, i.e. the section associated with only a portion of the nozzle bore. Selective actuation of a particular heater section, constitutes what has been termed an asymmetrical application of heat to the stream. Alternating the sections can, in turn, alternate the direction in which the asymmetrical heat is supplied and serves to thereby deflect ink drops, inter alia, between a "print" direction (onto a recording medium) and a "non-print" direction (back into a "catcher"). The patent of Chwalek et al. thus provides a liquid printing system that affords significant improvements toward overcoming the prior art problems associated with the number of nozzles per printhead, printhead length, power usage and characteristics of useful inks.

Asymmetrically applied heat results in stream deflection, the magnitude of which depends on several factors, e.g. the geometric and thermal properties of the nozzles, the quantity of applied heat, the pressure applied to, and the physical, chemical and thermal properties of the ink. Although solvent-based (particularly alcohol-based) inks have quite a good deflection patterns, and achieve high image quantity in asymmetrically heated continuous ink jet printers, water-based inks are more problematic as disclosed in commonly assigned U.S. application Ser. No. 09/451,790 filed Dec. 1, 1999 in the names of Trauernicht et al. The water-based inks do not deflect as much, thus their operation is not robust. In order to improve the magnitude of the ink droplet deflection within continuous ink jet asymmetrically heated printing systems there is disclosed in commonly assigned U.S. application Ser. No. 09/470,638 filed Dec. 22, 1999 in the names of Delametter et al. a continuous ink jet printer having improved ink drop deflection, particularly for aqueous based inks, by providing enhanced lateral flow characteristics, by geometric obstruction within the ink delivery channel.

The invention to be described herein builds upon the work of Chwalek et al., and in accordance with certain embodiments of the invention is an alternate, simpler, design to that of Delametter et al. for constructing continuous ink jet printheads in a variety of materials that are low-cost to manufacture and preferably for printheads that can be made page wide. Alternatively, in accordance with other embodiments of the invention which make use of the improvements disclosed by Delametter et al. improved performance can be achieved.

Although the invention may be used with ink jet printheads that are not considered to be page wide printheads there remains a widely recognized need for improved ink jet printing systems, providing advantages for example, as to cost, size, speed, quality, reliability, small nozzle orifice size, small droplets size, low power usage, simplicity of construction in operation, durability and manufacturability. In this regard, there is a particular long-standing need for the capability to manufacture page wide, high-resolution ink jet printheads. As used herein, term "page-wide" refers to printheads of a minimum length of about four inches. High-resolution implies nozzle density, for each ink color, of a minimum of about 300 nozzles per inch to a maximum of about 2400 nozzles per inch.

To take full advantages of page wide printheads with regard to increased printing speed, they must contain a large number of nozzles. For example, a conventional scanning type printhead may have only a few hundred nozzles per ink color. A four inch page wide printhead, suitable for the printing of photographs, should have a few thousand nozzles. While a scanned printhead is slowed down by the need for mechanically moving it across the page, a page wide printhead is stationary and paper moves past it. The image can theoretically be printed in a single pass, thereby substantially increasing the printing speed.

SUMMARY OF THE INVENTION

It is therefore an object of the invention to provide an improved CIJ printhead and method of printing using same.

In accordance with a first aspect of the invention, there is provided a continuous ink jet printhead comprising a substrate including an ink delivery channel having ink under pressure in a relief portion formed in the substrate; a thin membrane that comprises an overhang from the relief portion of the substrate, the thin membrane being substantially thinner than a thickness of the substrate and the overhang extending from the relief portion with a dimension OH; a nozzle bore which opens into the ink delivery channel to establish a continuous flow of ink in a stream from the nozzle bore, the nozzle bore being formed in the thin membrane at the overhand and having an exit opening with a respective diameter dimension, D; a heater adjacent the nozzle bore, the heater adapted to produce asymmetric heating of the stream of ink to control direction of the stream between a print direction and a non-print direction; and the nozzle bore being characterized by a dimensional relationship wherein the overhang dimension OH is related to the diameter dimension of the exit opening so that OH>=½ D; and wherein thickness t, of the membrane within which the nozzle bore is formed is related to the diameter dimension of the exit opening so that t<=0.33D.

In accordance with a second aspect of the invention, there is provided a continuous ink jet printhead comprising a nozzle bore formed in a thin membrane that overhangs from a relief portion of a substrate, the thin membrane being of thickness t to define the thickness of the nozzle bore and the nozzle bore being spaced from the relief portion of the substrate with a dimension OH, the nozzle bore having a respective diameter dimension D and characterized in that OH>=½ D; and wherein t<=0.33D.

In accordance with a third aspect of the invention, there is provided a method of operating a continuous ink jet printhead comprising providing a substrate having plural ink delivery channels formed therein each channel terminating at a respective nozzle bore, each nozzle bore being formed in a thin membrane that comprises an overhang from a relief portion of the substrate, the thin membrane being substantially thinner than the thickness of the substrate and the overhang extending from the relief portion with a dimension OH, the nozzle bore having a respective diameter dimension D, and the thin membrane having a thickness t, and wherein the overhand dimension is related to the diameter dimension so that OH>=½ D and wherein t<=0.33D; moving ink under pressure from the ink delivery channels formed in the substrate to each of the nozzle bores to cause ink to flow continuously from the nozzle bores; and selectively effecting collection of certain ink droplets in collection devices associated with the nozzle bores so that ink droplets not collected by the collection devices form a predetermined image on a receiver sheet.

These and other objects, features and advantages of the present invention will become apparent to those skilled in the art upon reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings.

DETAILED DESCRIPTION OF THE INVENTION

This description will be directed in particular to elements forming part of, or cooperating more directly with, apparatus in accordance with the present invention. It is to be understood that elements not specifically shown or described may take various forms as well known to those skilled in the art.

Figure 1:
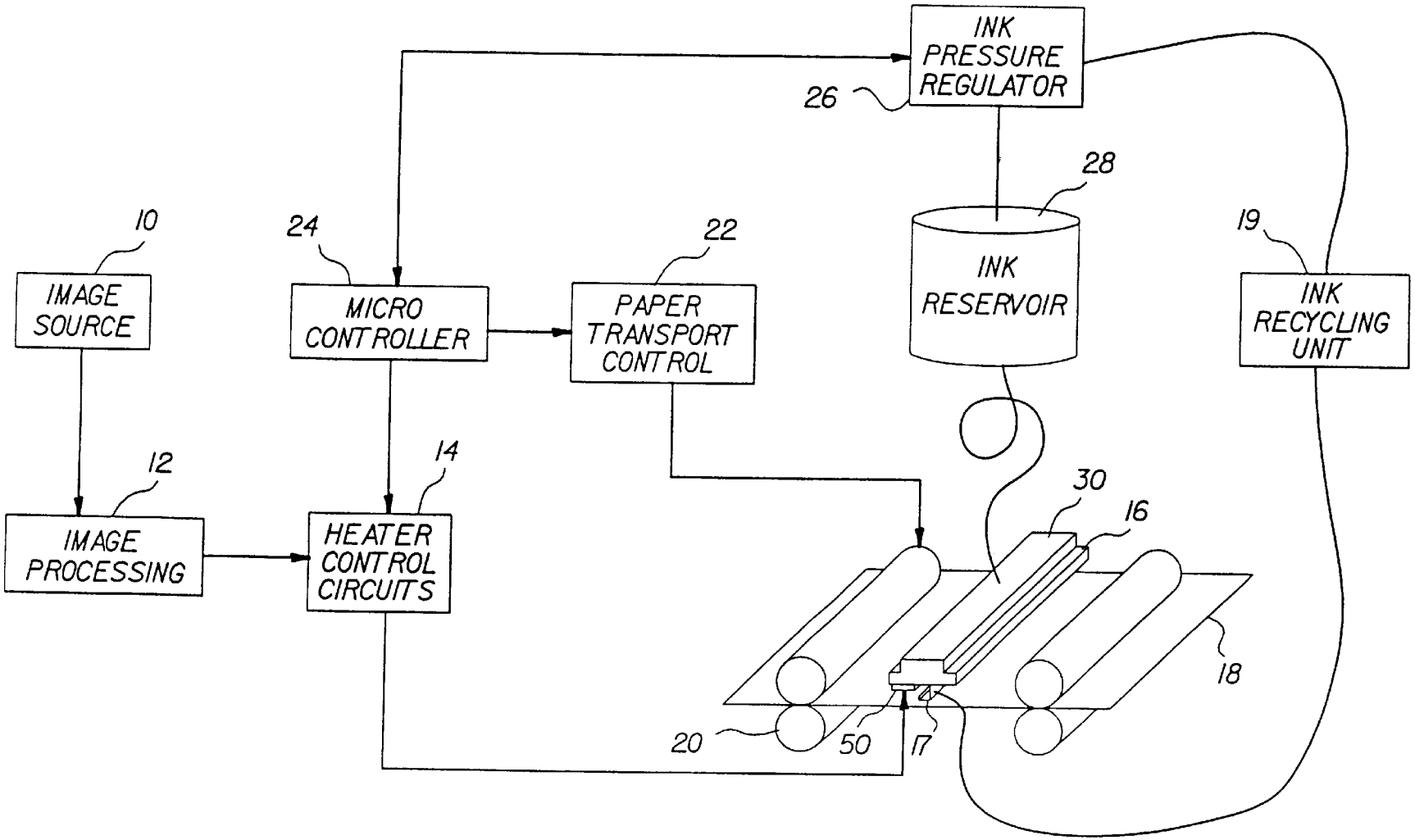
FIG. 1 is a block diagram of a continuous ink jet (CIJ) printing system in which the printhead of the present invention could be used.

As noted above, a continuous ink jet printer system that employs the method of asymmetric heating deflection is disclosed in the above-referred to U.S. Pat. No. 6,079,821. Following is a general description of the process employed. For specific details, please refer to the above-referred to U.S. Pat. No. 6,079,821. Referring to FIG. 1, the system includes an image source, 10, such as a scanner or computer which provides raster image data, outline image data in the form of a page description language, or other forms of digital image data. This image data is converted to single or multilevel (dropsize or volume or number of drops)bitmap image data by an image-processing unit, 12, that also stores the image data in memory. A plurality of heater control circuits, 14, read data from the image memory and apply time-varying electrical pulses to a set of nozzle heaters 50 that are part of a printhead, 16. These pulses are applied at an appropriate time, and to the appropriate nozzle, so that drops formed from a continuous ink jet stream will form spots on a recording medium in the appropriate position designated by the data in the image memory.

Recording medium, 18, is moved relative to a printhead by a recording medium transport system, 20, which is electronically controlled by a recording medium transport control system, 22, and which in turn is controlled by a micro-controller 24. In the case of page width printheads, it is most convenient to move a recording medium past a stationary printhead. However, in the case of scanning print systems, it is usually most convenient to move the printhead along one axis (the sub-scanning direction) and the recording medium along an orthogonal axis (the main scanning direction) in a relative raster motion. The recording medium is preferably in the form of a receiver sheet such as paper which may be coated although other receivers are contemplated including plastic, textiles including carpeting, and cardboard.

Ink is contained in an ink reservoir, 28, under pressure. In the non-printing state, continuous ink jet drop streams are unable to reach a recording medium due to an ink gutter, 17, that blocks the stream and which may allow a portion of the ink to be recycled by an ink recycling unit, 19. The ink-recycling unit reconditions the ink and feeds it back to a reservoir. Such ink recycling units as well known in the art. The ink pressure suitable for optimal operation will depend on a number of factors, including geometry and thermal properties of the nozzles and thermal properties of the ink. A constant ink pressure can be achieved by applying pressure to the ink reservoir under the control of an ink pressure regulator 26.

The ink is distributed to the back surface of a printhead by an ink channel device, 30. The ink preferably flows through slots and/or holes etched through a silicon substrate of the printhead to its front surface, where a plurality of nozzles and heaters are situated. With a printhead fabricated from silicon, it is possible to integrate heater control circuits with the printhead. However, the invention is not limited to silicon-based printheads as other materials may also be used including glass, plastic, stainless steel.

Figure 2:
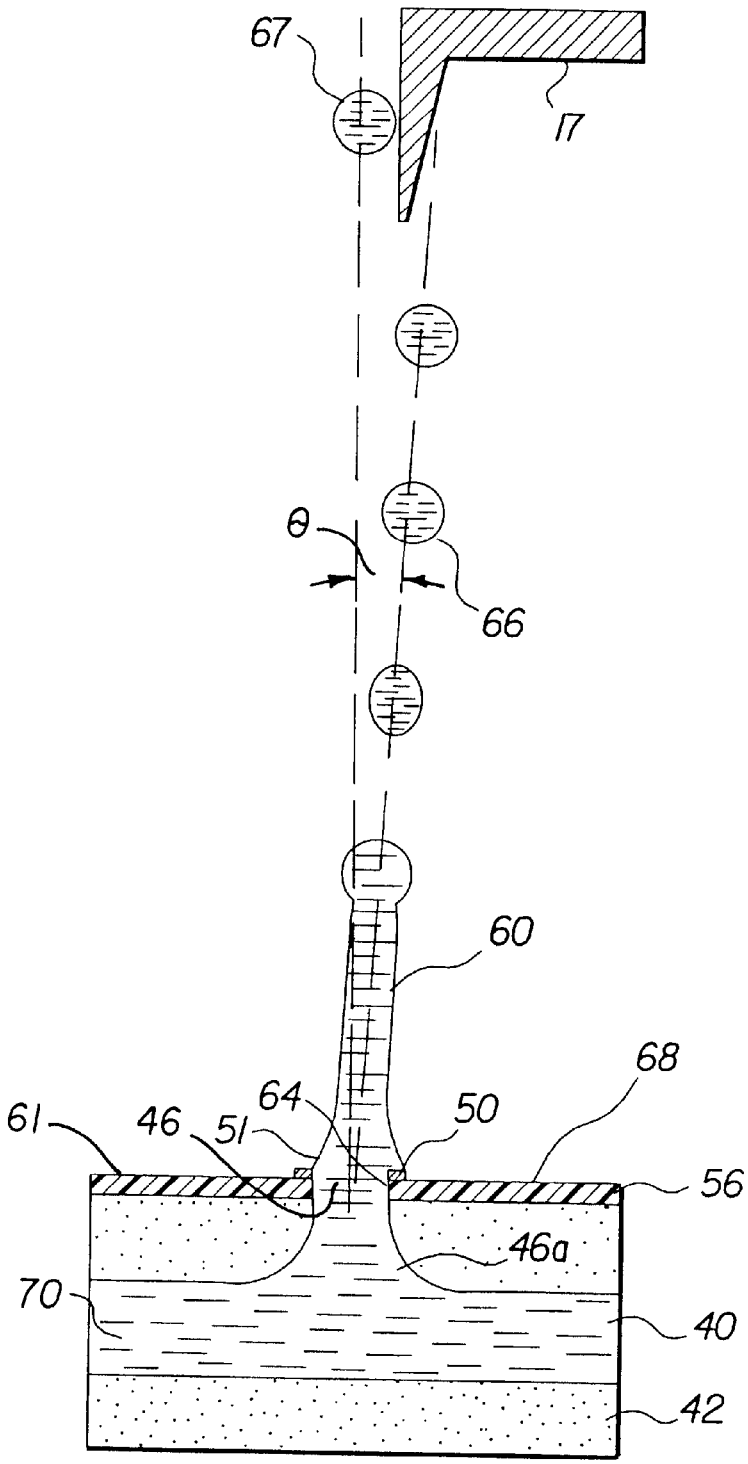
FIG. 2 (Prior Art)
FIG. 2 is a cross-sectional view of a known CIJ nozzle of a prior art printhead of which the invention is an improvement. The jet of fluid is shown breaking into drops both deflected and undeflected. The deflection angle, θ, is defined.

FIG. 2 is a cross-sectional view of one prior art nozzle of an array of such nozzles that form continuous ink jet printhead 16 of FIG. 1. An ink delivery channel 40, along with a plurality of nozzle bores 46 are etched in a substrate 42, which is silicon. Ink 70 in delivery channel 40 is pressurized above the atmospheric pressure, and forms a stream 60. At a distance above nozzle bore 46, stream 60 breaks into a plurality of drops 66 due to heat supplied by heater 50.

In the process of printing, an important system parameter is the angle at which the ink fluid deflects. FIG. 2 shows a cross-section of one nozzle of the printhead. The jet of fluid, 60, emanating from the nozzle is shown in the deflected state, with the deflected drops, 66, being captured by the gutter, 17. There is shown only one undeflected drop, 67. In this figure, the deflected drops are being captured by the gutter, but the system can be operated in the other manner such that the undeflected drops are captured, while the deflected drops are allowed to reach the recording medium. The deflection angle denoted by θ is the angle formed between a line connecting the deflected drops to the center of the nozzle bore in the printhead and a line normal to the plane of the printhead and through the middle of the same nozzle bore. Greater drop deflection results in a more robust system. The large the deflection angle θ the closer the ink gutter may be placed to the printhead and hence the printhead can be placed closer to the recording medium resulting in lower drop placement errors, which will result in higher image quality. Also, for a particular ink gutter to printhead distance, larger deflection angles by θ result in larger deflected drop to ink gutter spacing which would allow a large ink gutter to printhead alignment tolerance. Larger deflection angles by θ also allow larger amounts of (unintended) undeflected drop misdirection. Undeflected drop misdirection may occur, for instance, due to fabrication non-uniformity from nozzle to nozzle or due to dirt, debris, deposits, or the like that may form in or around the nozzle bore.

The cross-section of the nozzle construction shown in FIG. 2 is a shape typical of that well known in the ink jet field. See U.S. Pat. No. 6,089,698 by Temple et al., and U.S. Pat. No. 5,417,897 by Asakawa et al. in which methods are disclosed for making such nozzle cross-section shapes. The nozzle plate, 61, is composed of a series of nozzles bores 46 each featuring a tapered region, 46*a,* and in this case, a thin insulating layer, 56, in which the exit openings are formed and on top of which is formed the heaters, 50. The tapering of the tapered region tends to occur over a thickness comparable to the diameter of the exit orifice. In commonly assigned U.S. application Ser. No. 09/470,638 filed Dec. 22, 1999 in the names of Delametter et al., the use of a block within the ink chamber is disclosed for improving the deflection angle.

Figure 3:
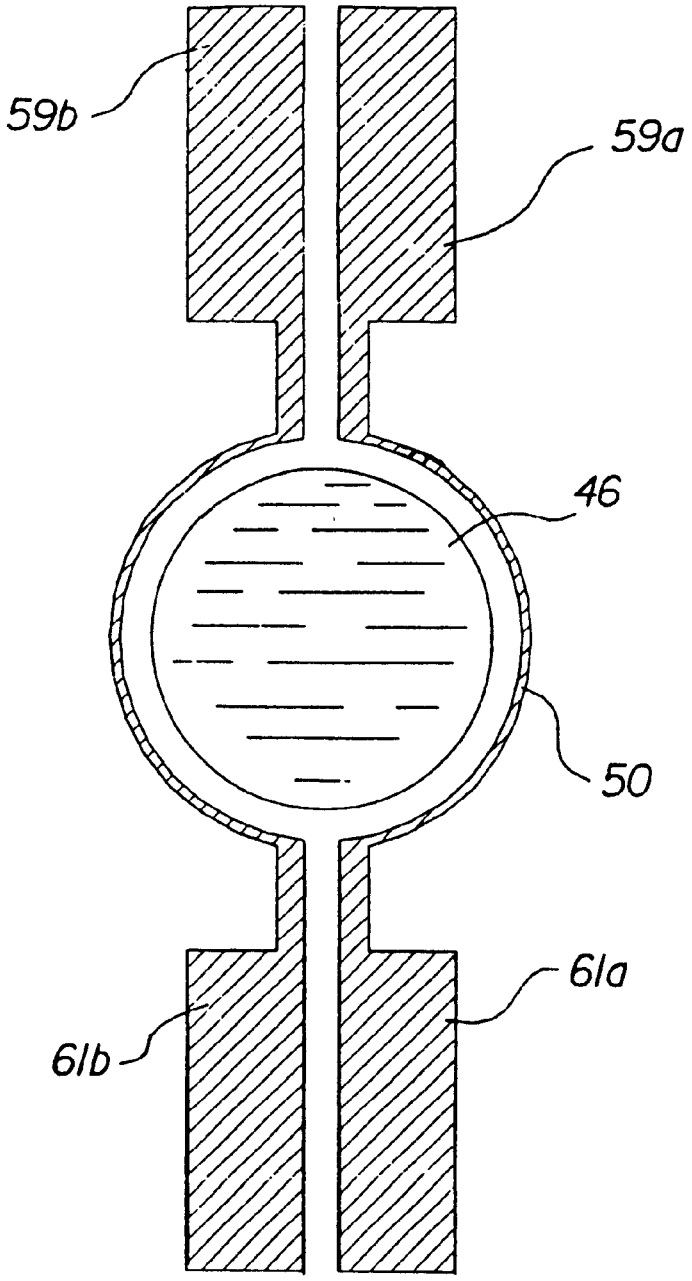
FIG. 3 (Prior Art)
FIG. 3 shows a top view of the nozzle with asymmetric heaters used for deflection of the inkjet stream.

Referring to FIG. 3, it is known from U.S. Pat. No. 6,079,821 to provide a heater that has two sections, each covering approximately 1-half of the nozzle parameter. Power connections 59*a* and 59*b* and ground connections 61*a* and 61*b* which form the drive circuitry to heater annulus 50 are also shown. Stream 60 may be deflected by an asymmetric application of heat by supplying electric current to one, but not both, of the heater sections. With stream 60 being deflected, drops 66 may be blocked from reaching recording medium 18 by a cut-off device such as the ink gutter 17. As noted above for an alternate printing scheme, ink gutter 17 may be placed to block undeflected drops 67 so that deflected drops 66 will be allowed to reach recording medium 18. Ink droplets traveling along the path such that the droplets reach recording medium 18 are considered to travel in a "print direction" while ink droplets traveling along the path such that the droplets do not reach the recording medium are considered to travel in a "non-print direction".

The heater of FIG. 3 may be made of polysilicon doped at a level of for example about 30 ohms/square or the heater may be TiN or other resistive heater material. Heater 50 is separated from substrate 42 by thermal and electrical insulating layers 56 to minimize heat lost to the substrate. The nozzle bore 46 is etched allowing the nozzle exit orifice to be defined by insulating layers 56. The layers in contact with the ink can be passivated with a thin film layer 64 for protection. The printhead surface may be coated with a hydrophobizing layers 68 to prevent accidental spread of the ink across the front of the printhead.

In a preferred embodiment of the present invention, a simpler configuration is used in which this tapered shaped for the cross-section of the nozzle is eliminated, and replaced by a thin membrane with an exit orifice. The heater is either incorporated within this thin membrane or on top. Nozzle exit orifice diameters may range from 1 to 100 micrometers, with a preferred range of 6 to 16 micrometers. The membrane thickness will be specified as a fraction of the orifice diameter and may range from 0.01 to 0.33 times the nozzle diameter. For a typical nozzle diameter of 8 to 12 micrometers, the membrane thickness is typically 2.5 micrometers or less, the minimum of 0.5 micrometers. The supporting material to which the membrane is attached is set back from perimeter of the orifice at least a distance of approximately one-half the nozzle diameter, D, Preferably the overhand, OH, from the supporting material is greater than or equal to ½ D.

The structure of this printhead has been described as having circular exit orifices. The shape of the exit orifice can be non-circular as disclosed by Jeanmaire et al. in commonly assigned U.S. Pat. No. 6,203,145, the contents of which are incorporated herein by reference. The considerations regarding the position of the supporting structure relative to the perimeter of the orifice is similar. The dimension of interest is the smaller dimension of a non-circular shape. Thus, for example, an elliptical shape to the orifice may be provided and the smaller diameter is the dimension of interest.

Figure 4B:
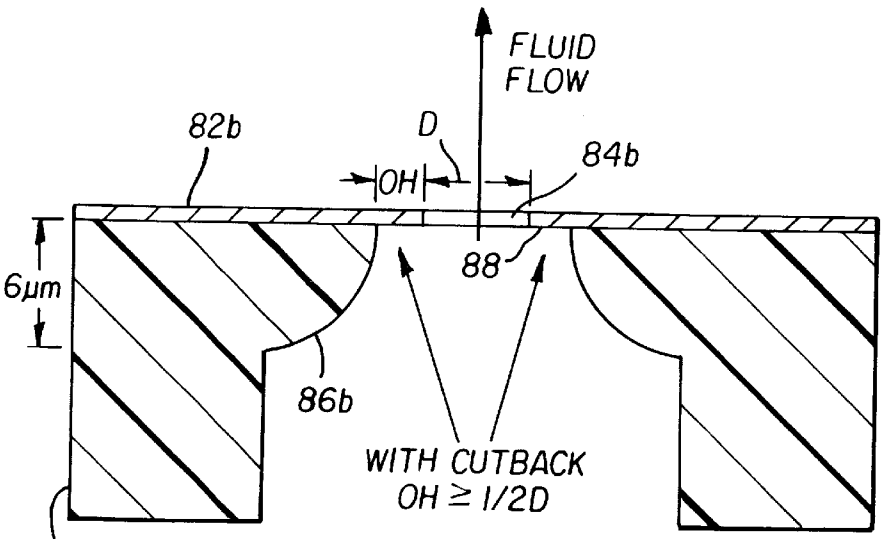
FIGS. 4*a* and 4*b* are cross-sectional views of two different nozzles used in one of the examples described in this application, the nozzle of FIG. 4*b* having a configuration in accordance with a first embodiment of the invention.
Figure 4A:
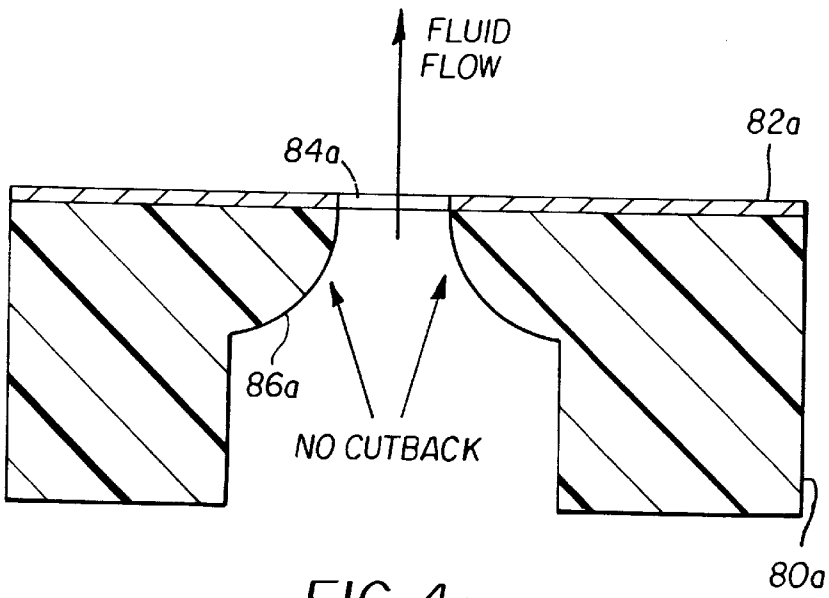

To illustrate the benefit of an overhang configuration to the nozzle orifice, the following experimental results are provided. Two printheads with nozzle cross-sectional configurations as shown in FIG. 4*a* and FIG. 4*b* were constructed and evaluated. The nozzle openings 84*a,* 84*b* respectively had a circular shape. The nozzle configurations will be referred to as "no-cutback" and "with-cutback," respectively. The samples were made from silicon wafers each serving as a substrate 80*a,*80*b* with an oxide layer 82*a,*82*b,* respectively, on top. Polysilicon heaters (not shown) in the shape of two semi-circles approximately 1 micrometer wide were formed on top of the oxide layer. The oxide layer was approximately 1 micrometer thick, with an approximately 0.4 micrometer thick poly-silicon heater on top. The depth of the curved taper region was approximately 6 micrometers. The with-cutback sample depicted in FIG. 4*b* was etched more so that the tapered area was removed approximately 6 micrometers from the edge of the bore to provide an overhand dimension OH, thus effectively forming a thin membrane in which the nozzle bore 84*b* is formed, and from which the fluid emanates. The nozzle bore was approximately 10.4 micrometers in diameter D. The fluid 2-propanol was used for comparison. The pressurized fluid was filtered, then fed into the ink channel forming a jet from the orifice traveling at approximately 10 meters per second. The pressure in the source bottle of 2-propanol was adjusted to give approximately equal velocities for the two samples. Slightly higher pressure is needed for the no-cutback sample (FIG. 4*a* embodiment) due to the higher viscous drag of the tapered region compared to the with-cutback sample. One of the semi-circular heaters of each nozzle of each embodiment was driven with a series of 2 microsecond wide voltage pulses at 125 kHz repetition rate to form a deflected line of drops. The voltage was adjusted for each sample to give approximately the same instantaneous heater temperature at the end of the heat pulses as determined by the instantaneous increase in resistance as determined by a separate current monitoring resistor in series with the heaters. This required a slightly higher voltage for the no-cutback sample due to the higher thermal conductivity of the silicon that remains under the oxide. The deflection angle measured for the no-cutback sample was approximately 0.8 degrees, while that for the with-cutback sample (FIG. 4*b* embodiment) was approximately 5.6 degrees. Thus, the removal of the typical tapered structure leaving a simple thin membrane results in a significant improvement in the performance of the system. It is believed that with use of such thin membranes as described herein that deflection angles of the ink jet streams in the range of 3 degrees to 10 degrees are possible.

Figure 5B:
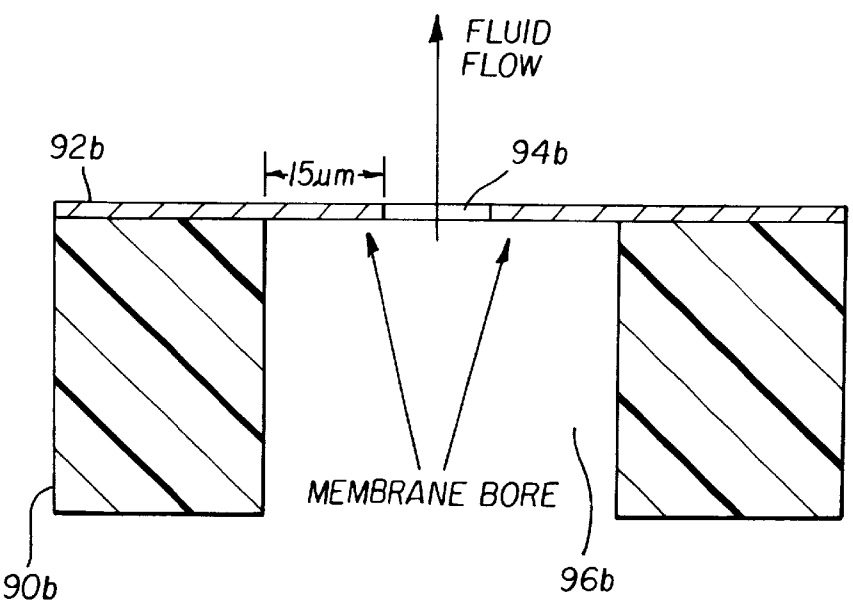
FIGS. 5*a* and 5*b* are cross-sectional views of two different nozzles used in another of the examples described in this application, the nozzle of FIG. 5*b* having a configuration in accordance with a second embodiment of the invention.
Figure 5A:
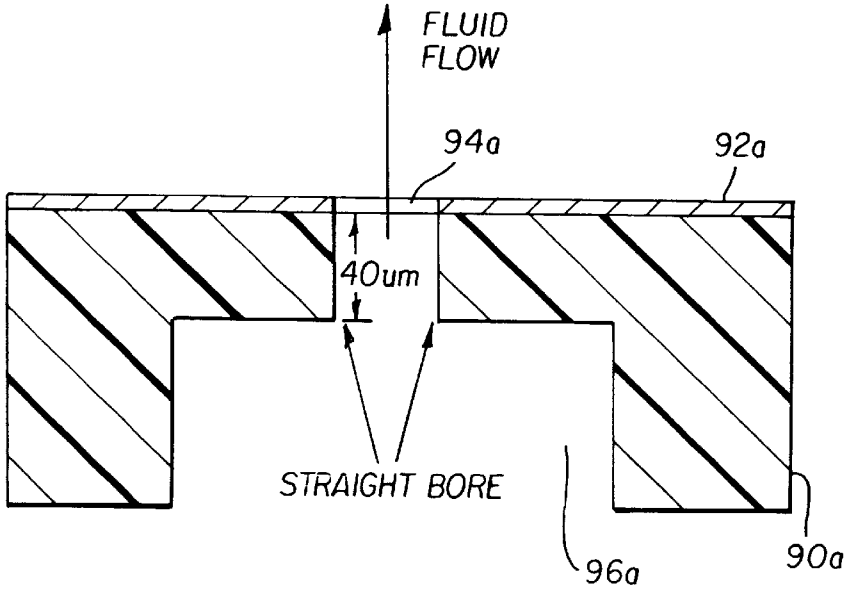

As further illustration of the benefits of this configuration, the following experimental results are provided. Two printheads with nozzle cross-sections as shown in FIG. 5*a* and FIG. 5*b* were constructed and evaluated. These will be referred to as "straight-bore" and "membrane-bore," respectively. The samples were made from silicon wafers forming respective substrates 90*a,*90*b* with an oxynitride layer 92*a,* 92*b* respectively on top. Polysilicon heaters (not shown) in the shape of two semi-circles approximately 1 micrometer wide were formed on top of the oxide layer. The oxynitride layer was approximately 2 micrometers thick, with an approximately 0.4 micrometer thick poly-silicon heater on top. The thickness of the silicon remain below the oxynitride that is part of the bore in the straight-bore sample depicted in FIG. 5*a*was approximately 40 micrometers. The membrane-bore sample depicted in FIG. 5*b* was etched more so that the silicon was removed from under the oxynitride to over 15 micrometers from the edge of the bore, thus effectively forming a thin membrane overhang in which the nozzle bore is formed, and from which the fluid emanates. The nozzle bore was approximately 10.8 micrometers in diameter. The fluid 2-propanol was used for comparison. The pressurized fluid was filtered, then fed into the ink channels 96*a,* 96*b* respectively forming a stream or jet of fluid from each of the orifices 94*a,* 94*b,* the respective streams traveling at approximately 9 to 10 meters per second. The pressure in the source bottle of 2-propanol was adjusted to give approximately equal velocities for the two samples. Slightly higher pressure is need for the straight-bore sample of FIG. 5*a* due to the higher viscous drag of the long bore region compared to the membrane-bore sample of FIG. 5*b*. One of the semi-circular heaters were driven with a series of 2 microsecond wide voltage pulses at 125 kHz repetition rate for form a deflected line of drops. The voltage was adjusted for each sample to give approximately the same instantaneous heater temperature at the end of the heat pulses as determined by the instantaneous increase in resistance as determined by a separate current monitoring resistor in series with the heaters. This required a higher voltage for the straight-bore sample due to the higher thermal conductivity of the silicon that remains under the oxynitrde. The deflection angle measured for the straight-bore sample was approximately 0.5 degrees, while that for the with-cutback sample was approximately 3 degrees. Thus, as taught herein, the removal of material from the straight-bore structure thus leaving a simple thin membrane overhang in which the nozzle orifice is formed results in a significant improvement in the performance of the system.

As noted above, it would be desirable to fabricate the printheads described herein as pagewidth printheads. There are two major difficulties in realizing page wide and high productivity ink jet printheads. The first is that nozzles have to be spaced closely together, of the order of 10 to 80 micrometers, center to center spacing. The second is that the drivers providing the power to the heaters and the electronics controlling each nozzle must be integrated with each nozzle, since attempting to make thousands of bonds or other types of connections to external circuits is presently impractical.

One way of meeting these challenges is to build the printheads on silicon wafers suitably doped utilizing VLSI technology and to integrate the CMOS circuits on the same silicon substrate with the nozzles.

While a custom process, as proposed in the patent to Silverbrook, U.S. Pat. No. 5,880,759 can be developed to fabricate the printheads, from a cost and manufacturability point of view it is preferable to first fabricate the circuits using a nearly standard CMOS process in a conventional VLSI facility. Then, to post process the wafers in a separate MEMS (micro-electromechanical systems) facility for the fabrication of the nozzles and ink channels.

Figure 6:
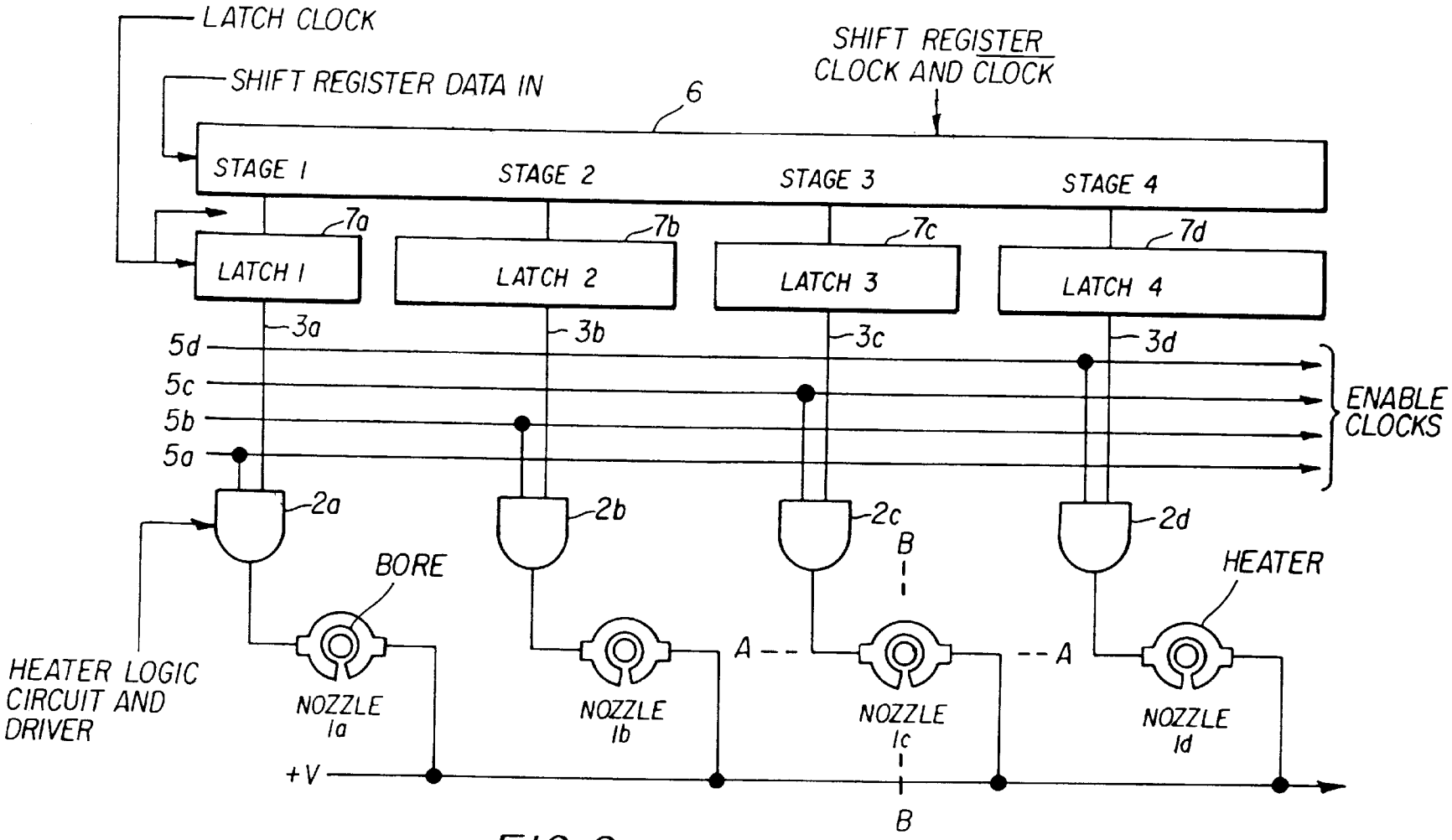
FIG. 6 is a schematic and fragmentary top view of a printhead constructed in accordance with a preferred embodiment of the present invention.

Referring to FIG. 6, there is shown a top view of an ink jet printhead according to the teachings of the present invention. The printhead comprises an array of nozzles 1*a*–1*d* arranged in a line or a staggered configuration. Each nozzle is addressed by a logic AND gate (2*a*–2*d*) each of which contains logic circuitry and a heater driver transistor (not shown). The logic circuitry causes a respective drive transistor to turn on if a respective signal on a respective data input line (3*a*–3*d*) to the AND gate (2*a*–2*d*) and the respective enable clock lines (5*a*–5*d*), which is connected to the logic gate, are both logic ONE. Furthermore, signals on the enable clock lines (5*a*–5*d*) determine durations of the lengths of time current flows through the heaters in the particular nozzles 1*a*–1*d*. Data for driving the heater driver transistor may be provided from processed image data that is input to a data shift register 6. The latch register 7*a*–7*d*, in response to a latch clock, receives the data from a respective shift register stage and provides a signal on the lines 3*a*–3*d* representative of the respective latched signal (logical ONE or ZERO) representing either that a dot is to be printed or not on a receiver. In the third nozzle, the lines A—A and B—B define the direction in which cross-sectional views are taken.

Figure 7A:
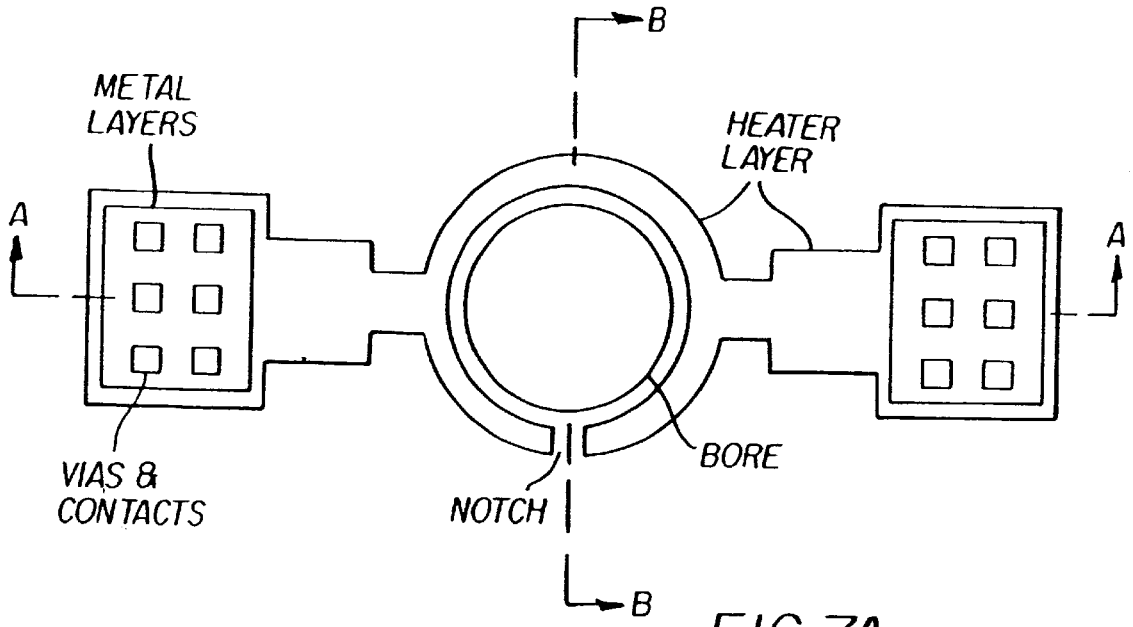
FIG. 7A is a simplified top view of a nozzle with a "notch" type heater for a CIJ printhead in accordance with the printhead of the invention.

FIGS. 7A–7F show more detailed top views of the two types of heaters (the "notch type" and "split type" respectively) used in CIJ printheads. They produce asymmetric heating of the jet and thus cause ink jet deflection. Asymmetrical application of heat merely means supplying electrical current to one or the other section of the heater independently in the case of a split type heater. In the case of a notch type heater applied current to the notch type heater will inherently involve an asymmetrical heating of the ink. With reference now to FIG. 7A, there is illustrating a top view of an ink jet printhead nozzle with a notched type heater. The heater is formed adjacent the exit opening of the nozzle. The heater element material substantially encircles the nozzle bore but for a very small notched out area, just enough to cause an electrical open. These nozzle bores and associated heater configurations are illustrated as being circular, but can be non-circular as disclosed by Jeanmaire et al. as noted above. As noted also with reference to FIG. 6, one side of each heater is connected to a common bus line, which in turn is connected to the power supply typically +5 volts. The other side of each heater is connected to a logic AND gate within which resides an MOS transistor driver capable of delivering up to 30 mA of current to that heater. The AND gate has two logic inputs. One is from the Latch 7*a*–*d* which has captured the information from the respective shift register stage indicating whether the particular heater will be activated or not during the present line time. The other input is the enable clock that determines the length of time and sequence of pulses that are applied to the particular heater. Typically there are two or more enable clocks in the printhead so that neighboring heaters can be turned on at slightly different times to avoid thermal and other cross talk effects.

Figure 7B:
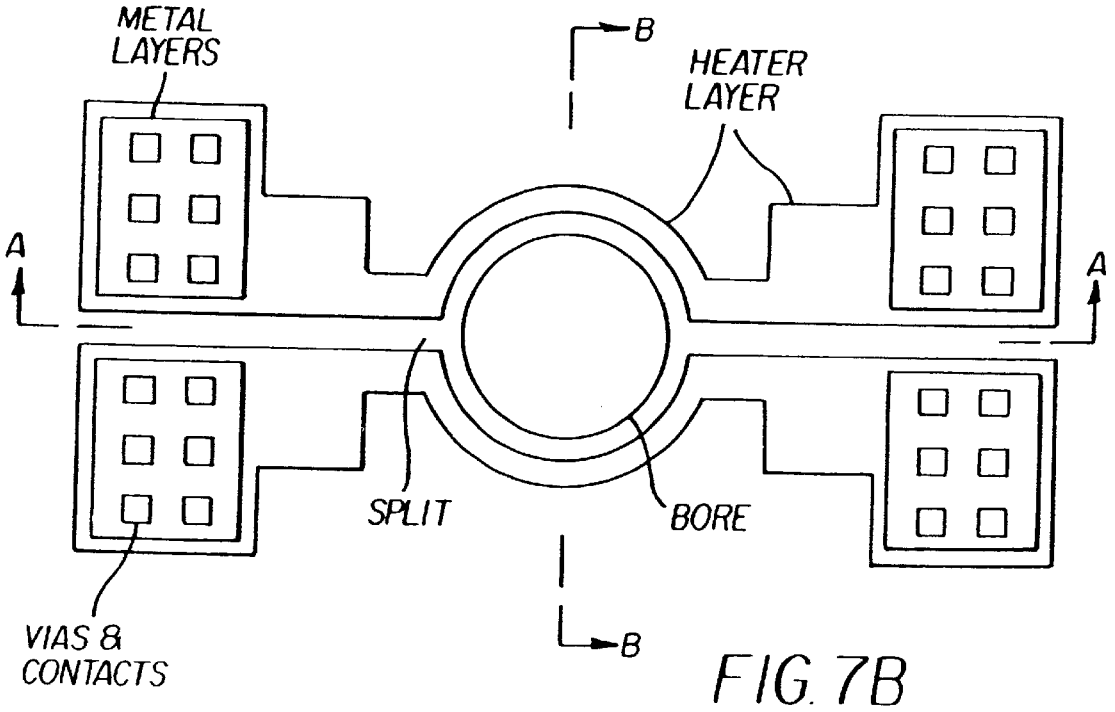
FIG. 7B is a simplified top view of a nozzle with a split type heater for a CIJ printhead made in accordance with the printhead of the invention.
Figure 7C:
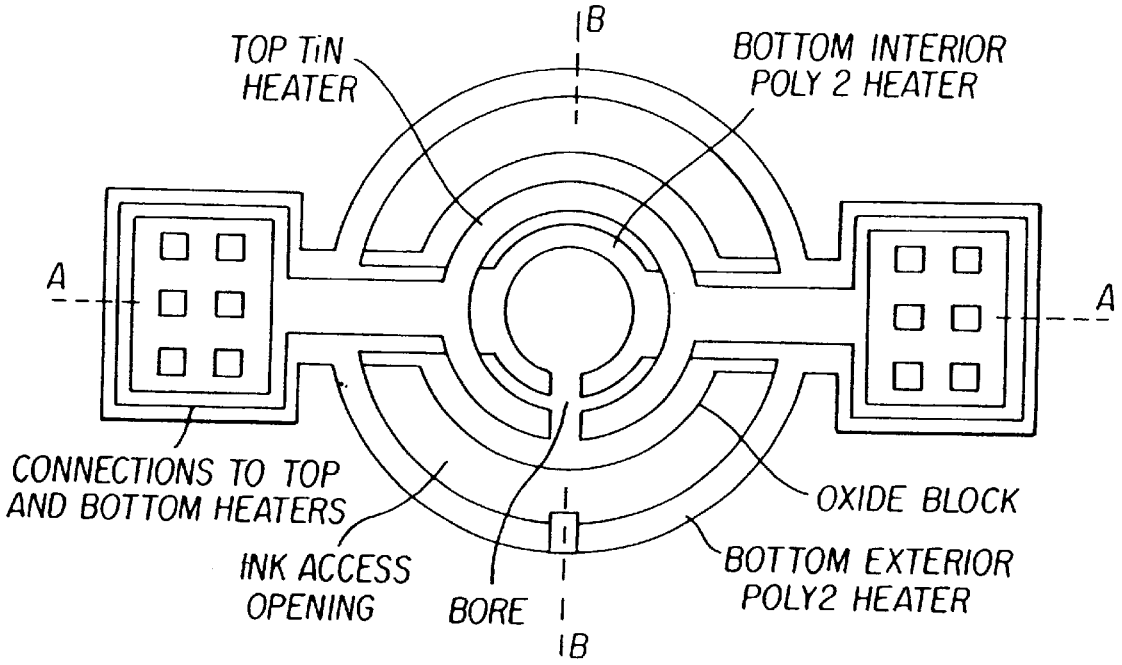
FIG. 7C is a simplified top view of a nozzle with top and dual bottom "notch" type heaters for a CIJ printhead in accordance with the printhead of the invention.
Figure 7D:
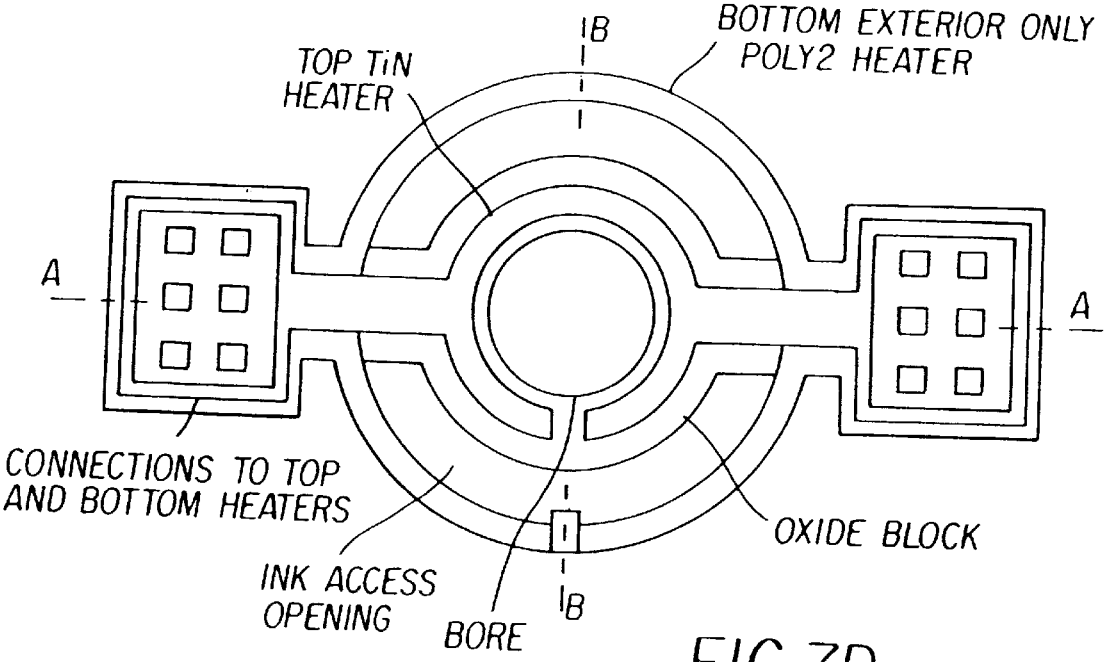
FIG. 7D is a simplified top view of a nozzle with top and single bottom "notch" type heaters for a CIJ printhead in accordance with the invention.
Figure 7E:
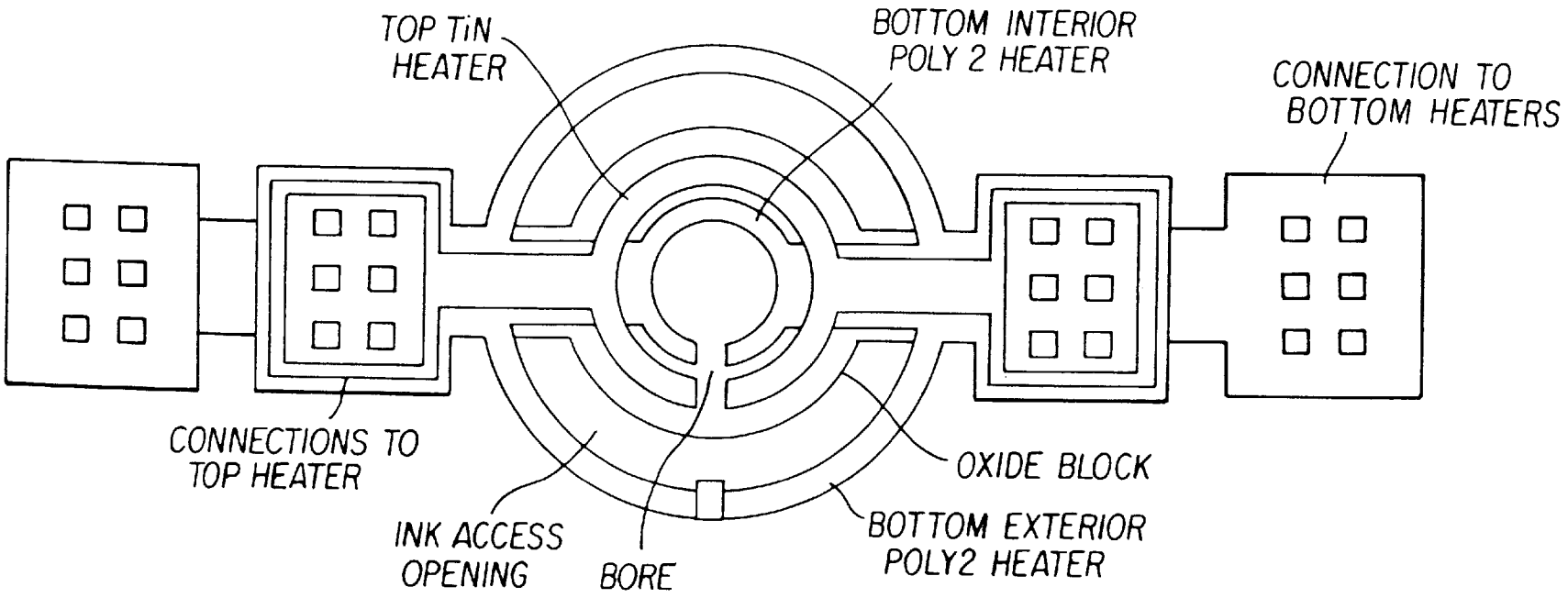
FIG. 7E is a simplified top view of a nozzle with top and dual bottom "notch" type heaters that are independently driven for a CIJ printhead in accordance with the invention.
Figure 7F:
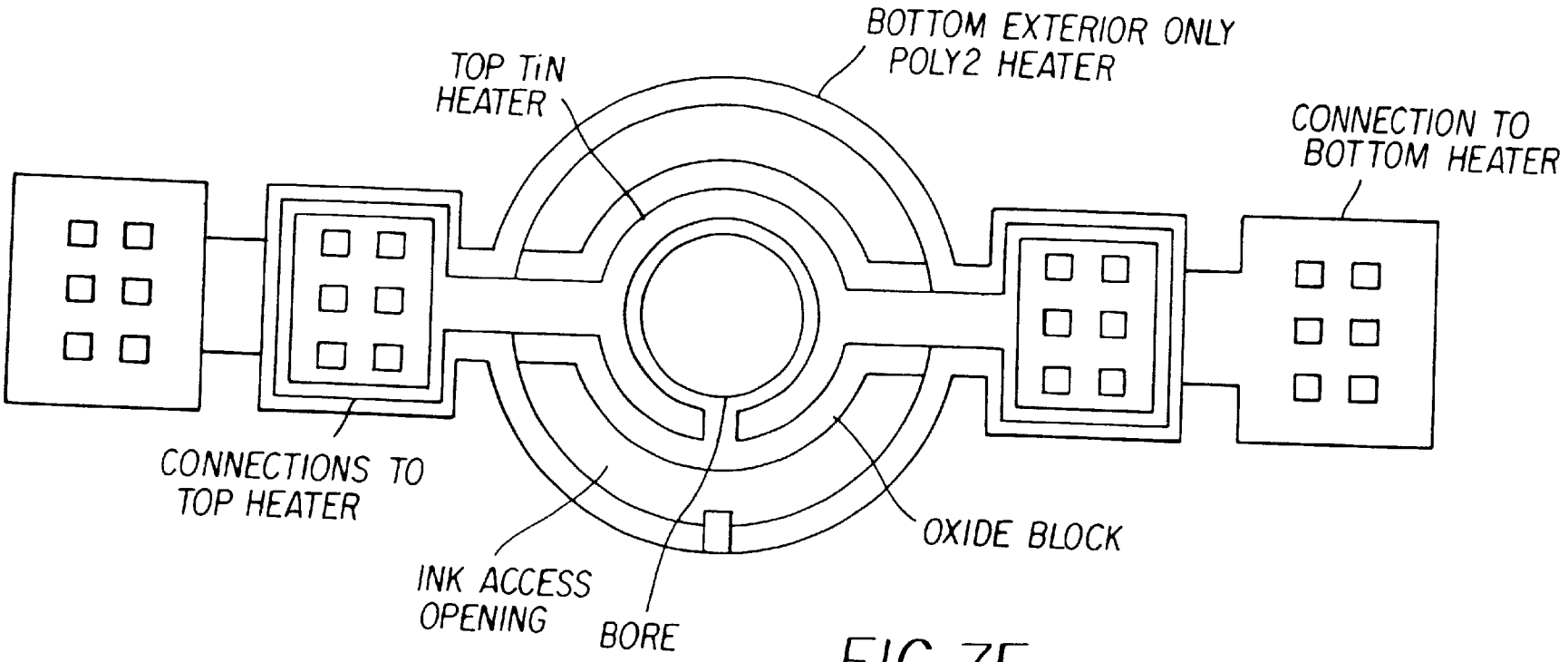
FIG. 7F is a simplified top view of a nozzle with top and single bottom "notch" type heaters that are independently driven for a CIJ printhead in accordance with the invention.

With reference to FIG. 7B, there is illustrated the nozzle with a split type heater wherein there are essentially two semicircular heater elements surrounding the nozzle bore adjacent the exit opening thereof. Separate conductors are provided to the upper and lower segments of each semi circle, it being understood that in this instance upper and lower refer to elements in 34 same plane. Vias are provided that electrically contact the conductors to metal layers associated with each of these conductors. These metal layers are in turn connected to driver circuitry formed on a silicon substrate as will be described below.

With reference to FIGS. 7C, 7D, 7E and 7F, there are illustrated nozzles with multiple notch heaters located at different heights along the ink flow path. Vias are provided that electrically contact the conductors to metal layers associated with each of the contact pads. These metal layers are in turn connected to driver circuitry formed on a silicon substrate as will be described below. The top and bottom heaters can be connected in parallel and thus fired simultaneously or have their own lines so they can be activated at different times. If not fired simultaneously, it is preferred to fire the bottom heaters at a small advance ahead of the top heaters.

In FIG. 2, there is shown a simplified cross-sectional view of an operating nozzle across the B—B direction. As mentioned above, there is an ink channel formed under the nozzle bores to supply the ink. This ink supply is under pressure typically between 15 to 25 psi for a typical bore diameter of about 8.8 micrometers and using a typical ink with a viscosity of 4 centipoise or less. The ink in the delivery channel emanates from a pressurized reservoir 28, leaving the ink in the channel under pressure. This pressure is adjusted to yield the desired velocity for the streams of fluid emanating from the nozzles. The constant pressure can be achieved by employing an ink pressure regulator 26. Without any current flowing to the heater, a jet forms that is straight and flows directly into the gutter. On the surface of the printhead a symmetric meniscus forms around each nozzle that is a few microns larger in diameter than the bore. If a current pulse is applied to the heater, the meniscus in the heated side pulls in and the jet deflects away from the heater. The droplets that form then bypass the gutter and land on the receiver. When the current through the heater is returned to zero, the meniscus becomes symmetric again and the jet direction is straight. The device could just as easily operate in the opposite way, that is, the deflected droplets are directed into the gutter and the printing is done on the receiver with the non-deflected droplets. Also, having all the nozzles in a line is not absolutely necessary. It is just simpler to build a gutter that is essentially a straight edge rather than one that has a staggered edge that reflects the staggered nozzle arrangement.

In typical operation, the heater resistance is of the order of 400 ohms for a heater conforming to an 8.8 micrometers diameter bore, the current amplitude is between 10 to 20 mA, the pulse duration is about 2 microseconds and the resulting deflection angle for pure water is of the order of a few degrees, in this regard reference is made to commonly assigned U.S. application Ser. No. 09/221,256, entitled "Continuous Ink Jet Printhead Having Power-Adjustable Multi-Segmented Heaters" now U.S. Pat. No. 6,213,595 and to U.S. application Ser. No. 09/221,342 entitled "Continuous Ink Jet Printhead Having Multi-Segmented Heaters", both filed Dec. 28, 1998 now U.S. Pat. No. 6,217,163.

The application of periodic current pulses causes the jet to break up into synchronous droplets, to the applied pulses. These droplets form about 100 to 200 micrometers away from the surface of the printhead and for an 8.8 micrometers diameter bore and about 2 microseconds wide, 200 kHz pulse rate, they are typically 3 to 4 pL in volume. The drop volume generated is a function of the pulsing frequency, the bore diameter and the jet velocity. The jet velocity is determined by the applied pressure for a given bore diameter and fluid viscosity as mentioned previously. The bore diameter may range from 1 micrometer to 100 micrometers, with a preferred range being 6 micrometers to 16 micrometers. Thus the heater pulsing frequency is chosen to yield the desired drop volume.

Figure 8:
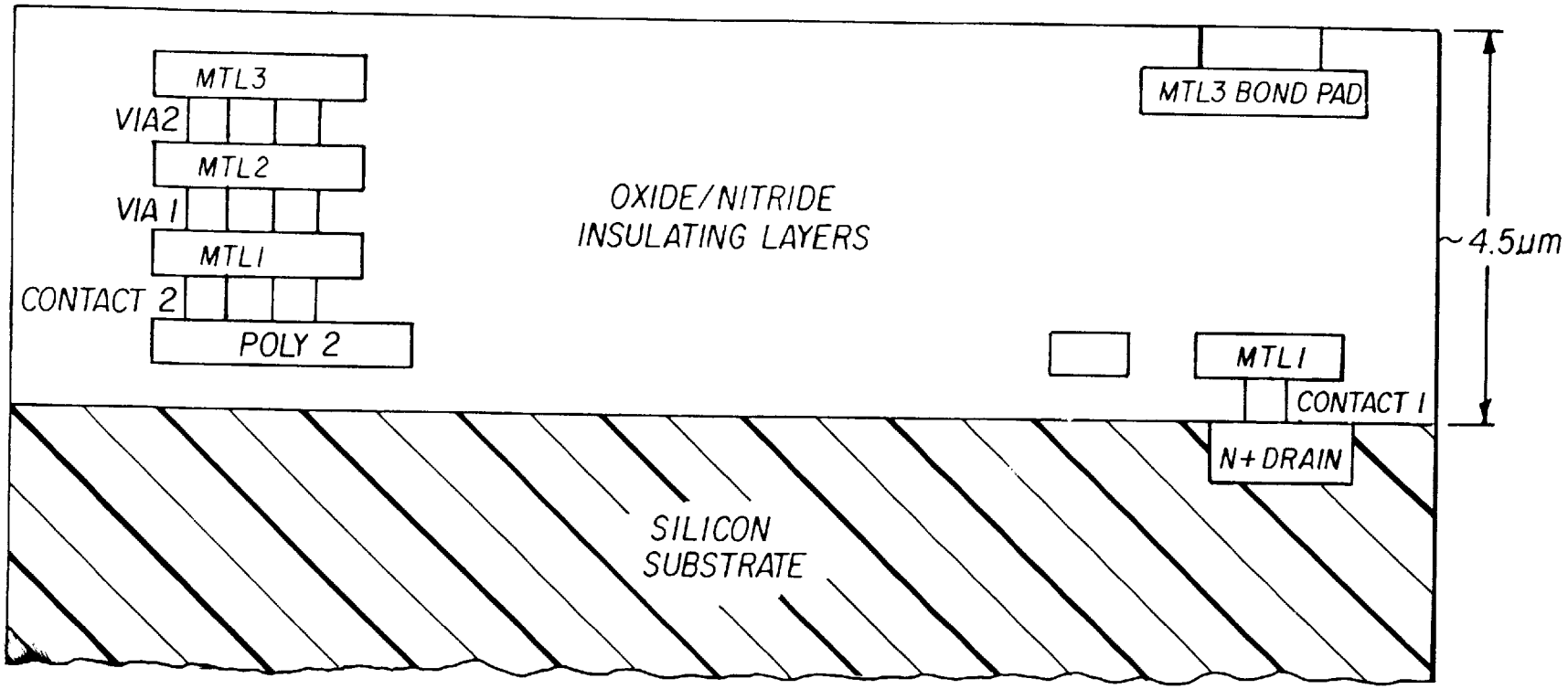
FIG. 8 is a simplified schematic sectional view taken along line A–B of FIG. 7D and illustrating the nozzle are just after the completion of all the conventional CMOS fabrication steps in accordance with a preferred embodiment of the invention.

The cross-sectional view taken along sectional line A-B and shown in FIG. 8 represents an incomplete stage in the formation of a printhead in which nozzles are to be later formed in an array wherein CMOS circuitry is integrated on the same silicon substrate.

As was mentioned earlier, the CMOS circuitry is fabricated first on the silicon wafers as one or more integrated circuits. The CMOS process may be a standard 0.5 micrometers mixed signal process incorporating two levels of polysilicon and three levels of metal on a six inch diameter wafer. Wafer thickness is typically 675 micrometers. In FIG. 8, this process is represented by the three layers of metal, shown interconnected with vias. Also polysilicon level 2 and an N+ diffusion and contact to metal layer 1 are drawn to indicate active circuitry in the silicon substrate. The gate electrodes of the CMOS transistor devices are formed using one of the polysilicon layers.

Because of the need to electrically insulate the metal layers, dielectric layers are deposited between them making the total thickness of the film on top of the silicon wafer about 4.5 micrometers.

The structure illustrated in FIG. 8 basically would provide the necessary interconnects, transistors and logic gates for providing the control components illustrated in FIG. 6.

As a result of the conventional CMOS fabrication steps, a silicon substrate of approximately 675 micrometers in thickness and about 6 inches in diameter is provided. Larger or smaller diameter silicon wafers can be used equally as well. A plurality of transistor devices are formed in the silicon substrate through conventional steps of selectively depositing various materials to form these transistors as is well known. Supported on the silicon substrate are a series of layers eventually forming an oxide/nitride insulating layer that has one or more layers of polysilicon and metal layers formed therein in accordance with desired pattern. Vias are provided between various layers as needed and openings may be provided in the surface for allowing access to metal layers to provide for bond pads. The various bond pads are provided to make respective connections of data, latch clock, enable clocks, and power provided from a circuit board mounted adjacent the printhead.

Figure 9:
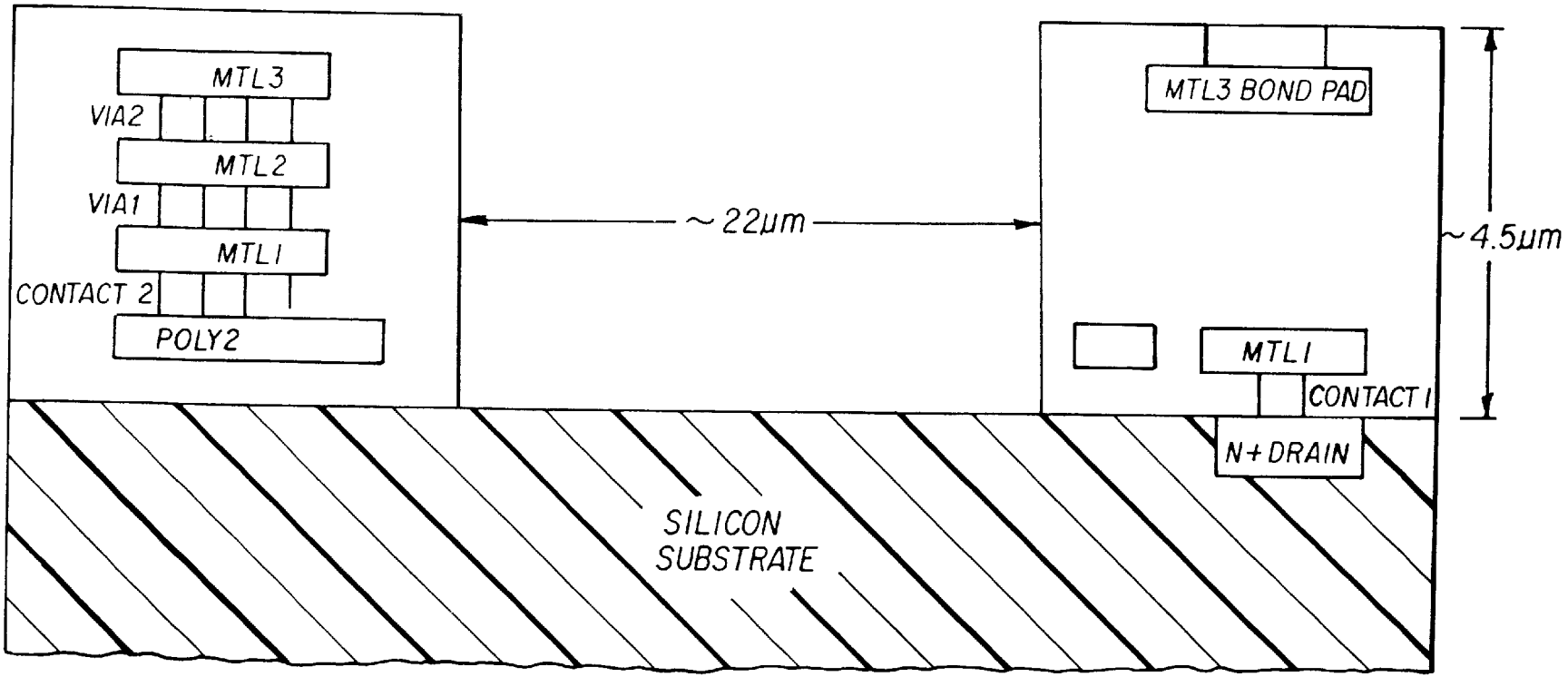
FIG. 9 is a simplified schematic cross-sectional view taken along line A–B of FIG. 7D in the nozzle area after the definition of a large bore in the oxide block using the device formed in FIG. 8.

With reference now also to FIG. 9 which is a similar view to that of FIG. 8 and also taken along line A-B, a mask has been applied to the front side of the wafer and a window of 22 micrometers in diameter is defined. The dielectric layers in the window are then etched down to the silicon surface, which provides a natural etch stop as shown in FIG. 9.

Figure 10:
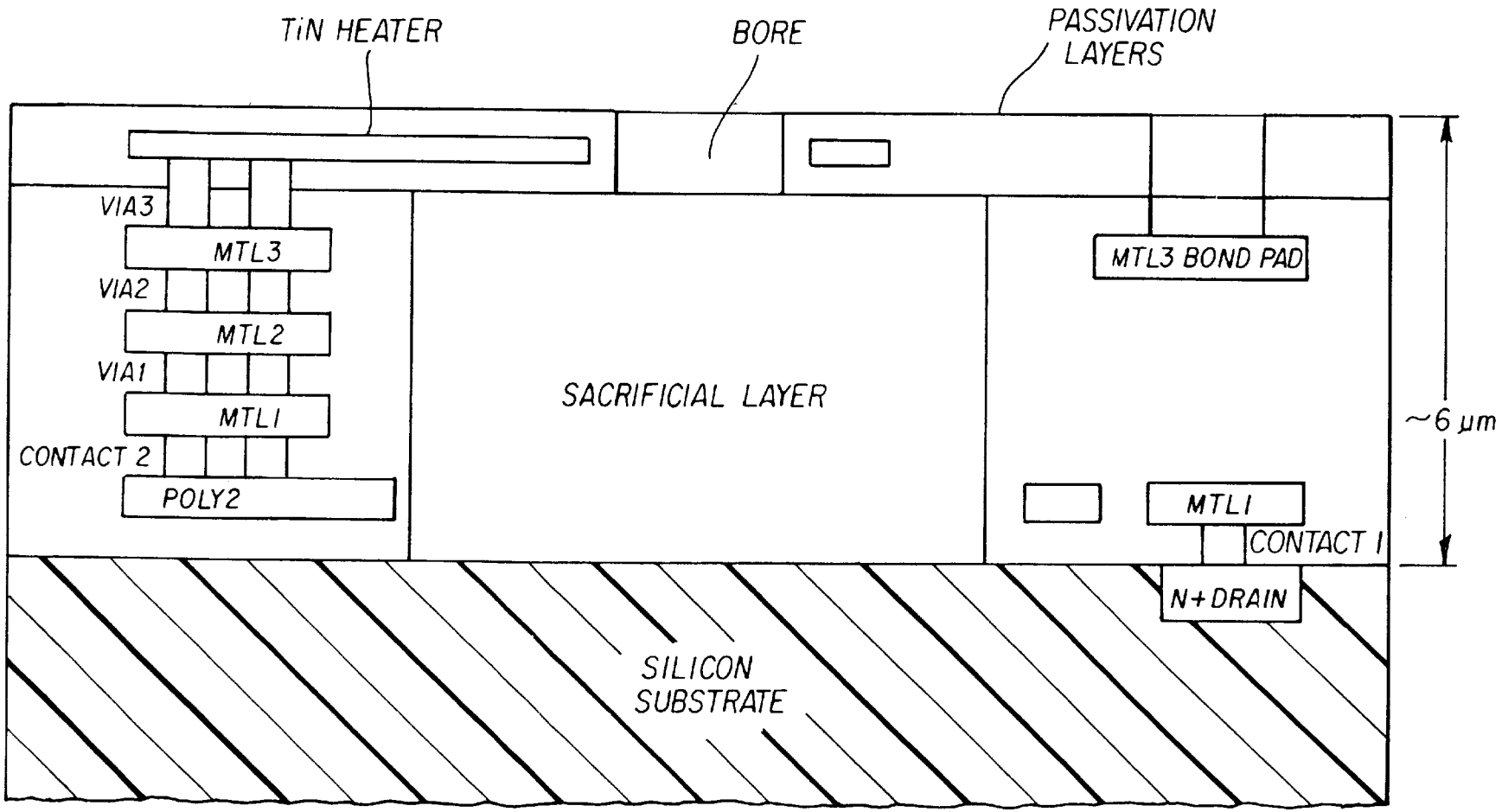
FIG. 10 is a schematic cross-sectional view taken along the line A–B in the nozzle area after deposition and planarization of the sacrificial layer and deposition and definition of the passivation and heater layers and formation of the nozzle bore.

With reference now to FIG. 10, a number of steps are shown combined in this figure. The first step is to fill in the window opened in the previous step with a sacrificial layer such as amorphous silicon or polyimide. The sacrificial layer is deposited sufficiently thick to fully cover the recesses formed between the front surface of the oxide/nitride insulating layer and the silicon substrate. These films are deposited at a temperature lower than 450 degrees centigrade to prevent melting of aluminum layers that are present. The wafer is then planarized.

A thin, about 3500 angstroms, protection layer, such as PECVD silicon nitride, is deposited next and then the via''s to the metal 3 layer are opened. The vias can be filled with Ti/TiN/W and planarized, or they can be etched with sloped sidewalls so that the heater layer, which is deposited next can directly contact the metal3 layer. The heater layer consisting of about 50 angstroms of Ti and 600 angstroms of TiN is deposited and then patterned. A final thin protection (typically referred to as passivation) layer is deposited next. This layer must have properties that, as the one below the heater, protects the heater from the corrosive action of the ink, it must not be easily fouled by the ink and can be cleaned easily when fouled. It also provides protection against mechanical abrasion.

A mask for fabricating the bore is applied next and the passivation layers are etched to open the bore and the bond pads. FIG. 10 shows the cross-sectional view of the nozzle at this stage. It will be understood of course that along the silicon array many nozzle bores are simultaneously etched.

Figure 11:
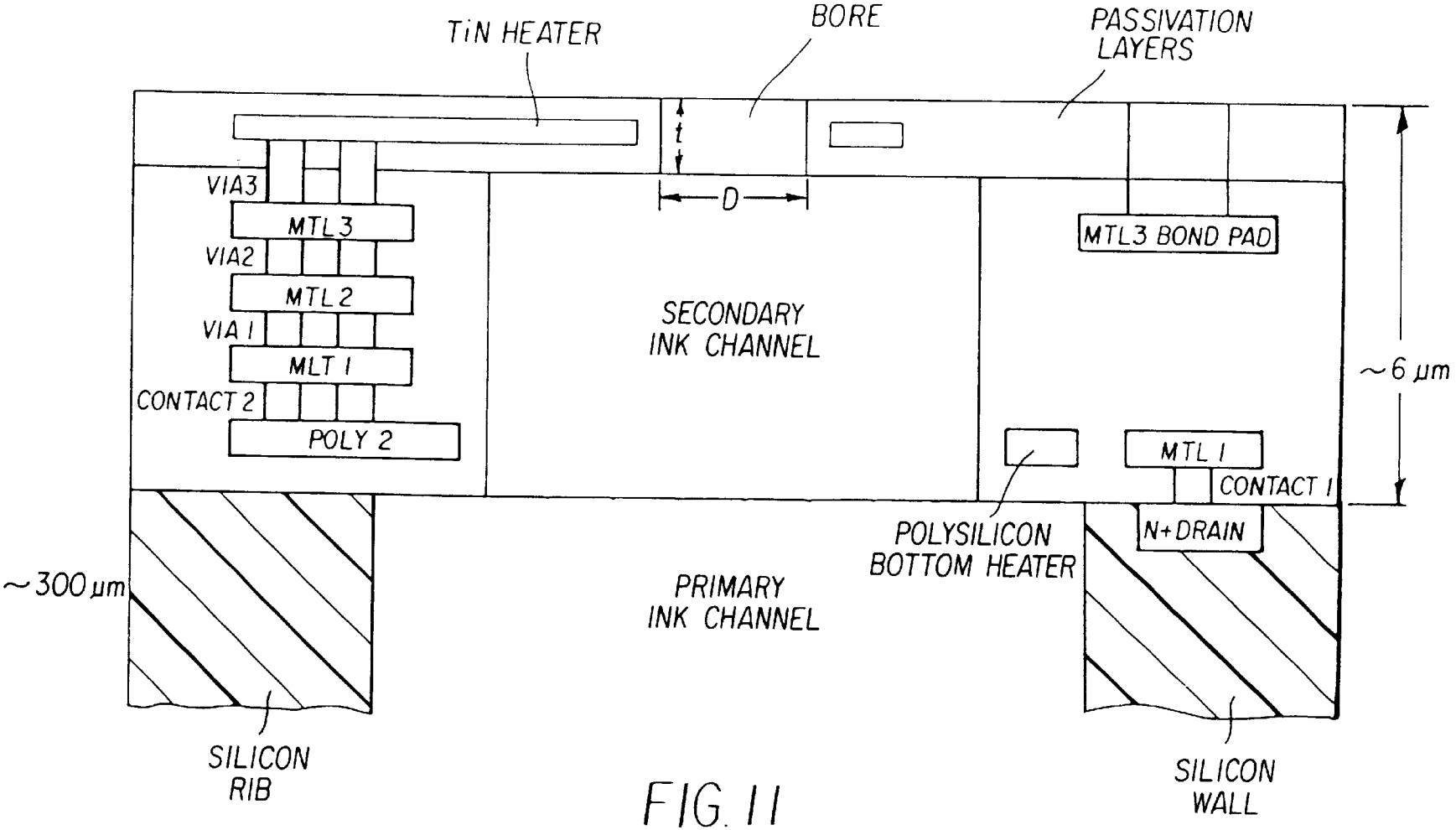
FIG. 11 is a schematic cross-sectional view taken along line A–B in the nozzle area after formation of the ink channels and removal of the sacrificial layer.

The silicon wafer is then thinned from its initial thickness of 675 micrometers to 300 micrometers, see FIG. 11, a mask to open the ink channels is then applied to the backside of the wafer and the silicon is etched, in an STS etcher, all the way to the front surface of the silicon. Thereafter, the sacrificial layer is etched from the backside and the front side resulting in the finished device shown in FIG. 11. It is seen from FIG. 11 that the device now has a flat top surface for easier cleaning and the bore is shallow enough for increased jet deflection. Bore diameters, D, may be in the range of one micrometer to 100 micrometers, with the preferred range being 6 micrometers to 16 micrometers. The thickness of the resulting membrane, t, may be in the range of 0.5 micrometers to 6 micrometers, with the preferred range being 0.5 micrometers to 2.5 micrometers. The thin membrane in which each exit orifice is located is characterized herein by having a thickness that is no more than 0.33 times, and more preferably no more than 0.25 times and even more preferably no more than 0.15 times the diameter of the nozzle bore. Furthermore, the temperature during post-processing was maintained below the 420 degrees centigrade annealing temperature of the heater, so its resistance remains constant for a long time. As may be noted from FIG. 11 the embedded heater element effectively surrounds the nozzle bore and is proximate to the nozzle bore which reduces the temperature requirement of the heater for heating the ink jet in the bore.

In FIG. 11, the printhead structure is illustrated with the bottom polysilicon layer extended to the ink channel formed in the oxide layer to provide a polysilicon bottom heater element. The bottom heater element is used to provide an initial preheating of the ink as it enters the ink channel portion in the oxide layer. This structure is created during the CMOS process. However, in accordance with the broader aspects of the invention the supplementary heater elements formed in the polysilicon layer are not essential.

Figure 12:
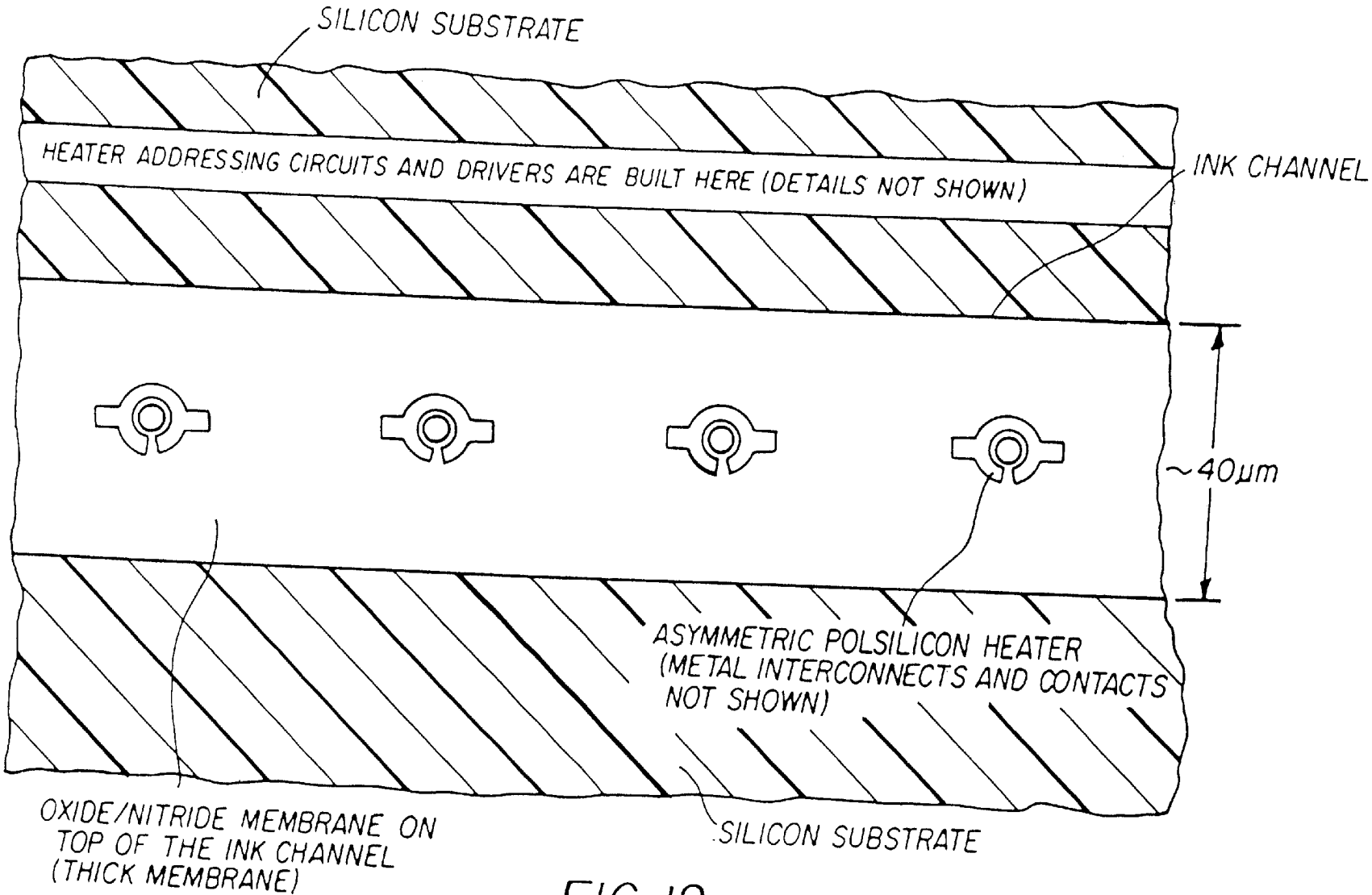
FIG. 12 is a simplified representation of the top view of a small array of nozzles made using the fabrication method illustrated in FIG. 11 and showing a central rectangular ink channel formed in the silicon block.
Figure 13:
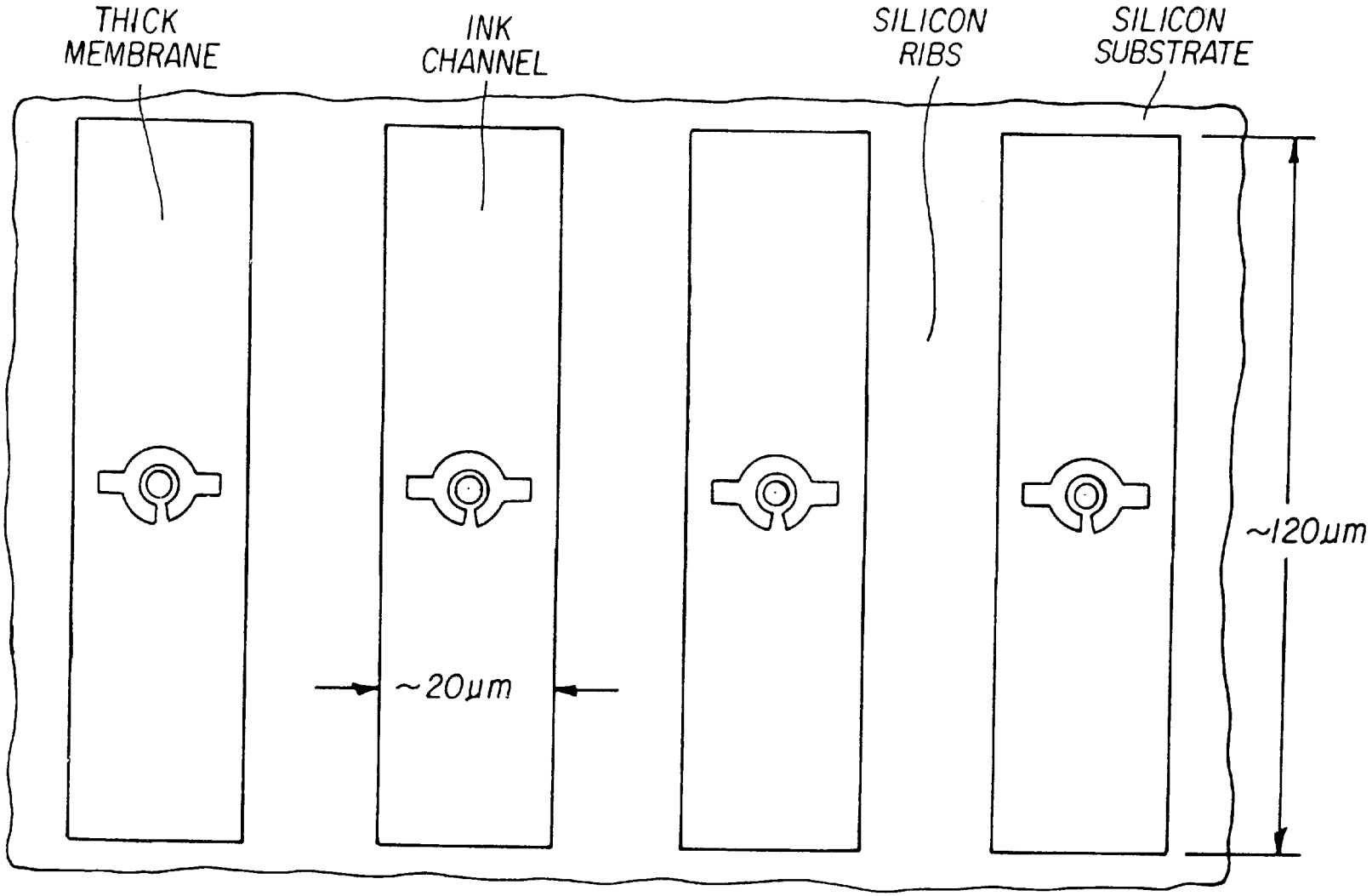
FIG. 13 is a view similar to that of FIG. 12 but illustrating rib structures formed in the silicon wafer that separate each nozzle and which provide increased structural strength and reduce wave action in the ink channel. The rib structures are not actually visible in a top view.

With reference to FIG. 12, the ink channel formed in the silicon substrate is illustrated as being a rectangular cavity passing centrally beneath the nozzle array. However, a long cavity in the center of the die tends to structurally weaken the printhead array so that if the array was subject to torsional stresses, such as during packaging, the membrane could crack. Also, along printheads, pressure variations in the ink channels due to low frequency pressure waves can cause jet jitter. Description will now be provided of an improved design made in accordance with the invention. This improved design consists of leaving behind a silicon bridge or rib between each nozzle of the nozzle array during the etching of the ink channels. These bridges extend all the way from the back of the silicon wafer to front of the silicon wafer. The ink channel pattern defined in the back of the wafer, therefore, is no longer a long rectangular recess running parallel to the direction of the row of nozzles but is instead a series of smaller rectangular cavities each feeding a single nozzle. To reduce fluidic resistance each individual ink channel is fabricated to be a rectangle of 20 micrometers along the direction of the row of nozzles and 120 micrometers in the direction orthogonal to the row of nozzles, see FIG. 13.

As noted above, in a CIJ printing system it is desirable that jet deflection could be further increased by increasing the portion of ink entering the bore of the nozzle with lateral rather than axial momentum. Such can be accomplished by blocking some of the fluid having axial momentum by building a block in the center of each nozzle just below the nozzle bore.

In accordance with another embodiment of the invention, a method of constructing a lateral flow structure will now be described. It will be understood of course that although the description will be provided in the following paragraphs relative to formation of a single nozzle that the process is simultaneously applicable to a whole series of nozzles formed in a straight or staggered row along the wafer.

Figure 14:
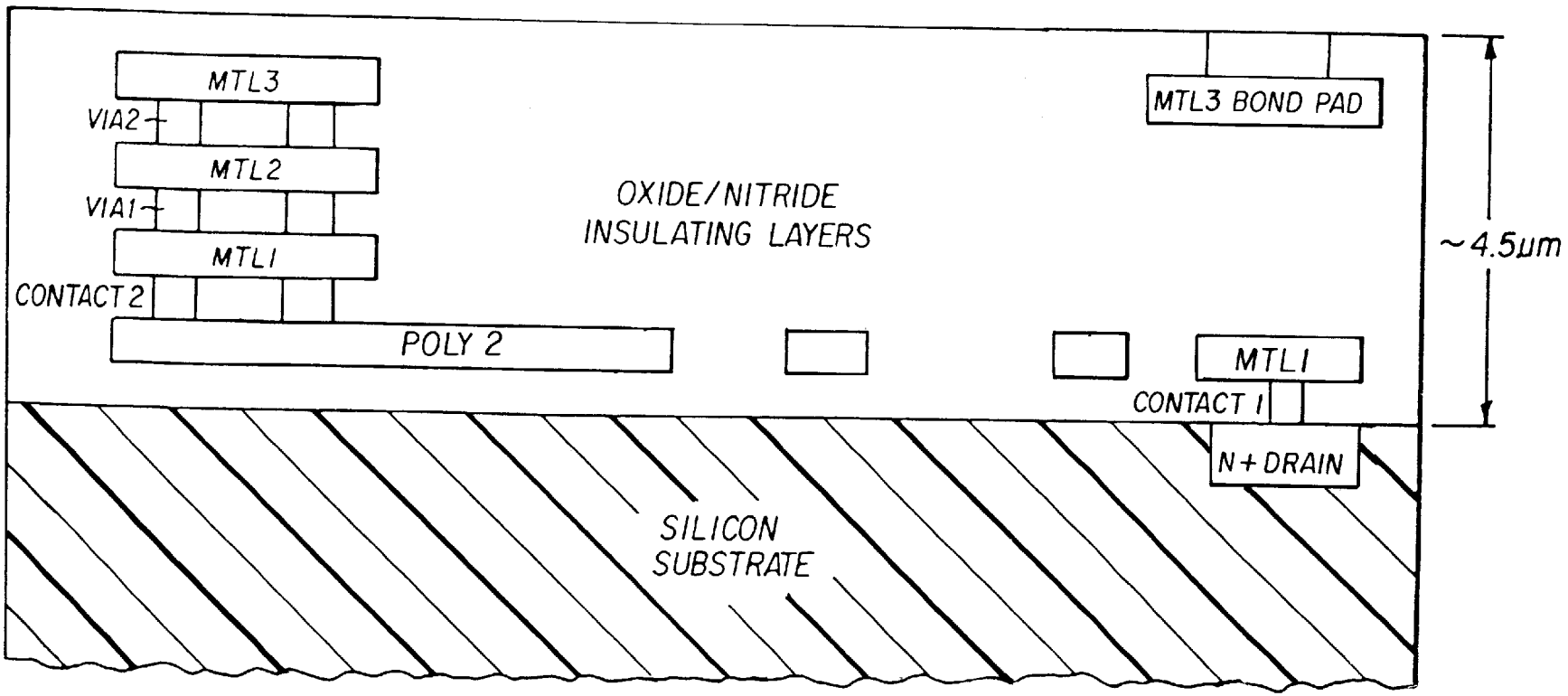
FIG. 14 is a simplified schematic sectional view taken along line A–B of FIG. 7C and illustrating the nozzle area just after the completion of all the conventional CMOS fabrication steps in accordance with another preferred embodiment of the invention.
Figure 15:
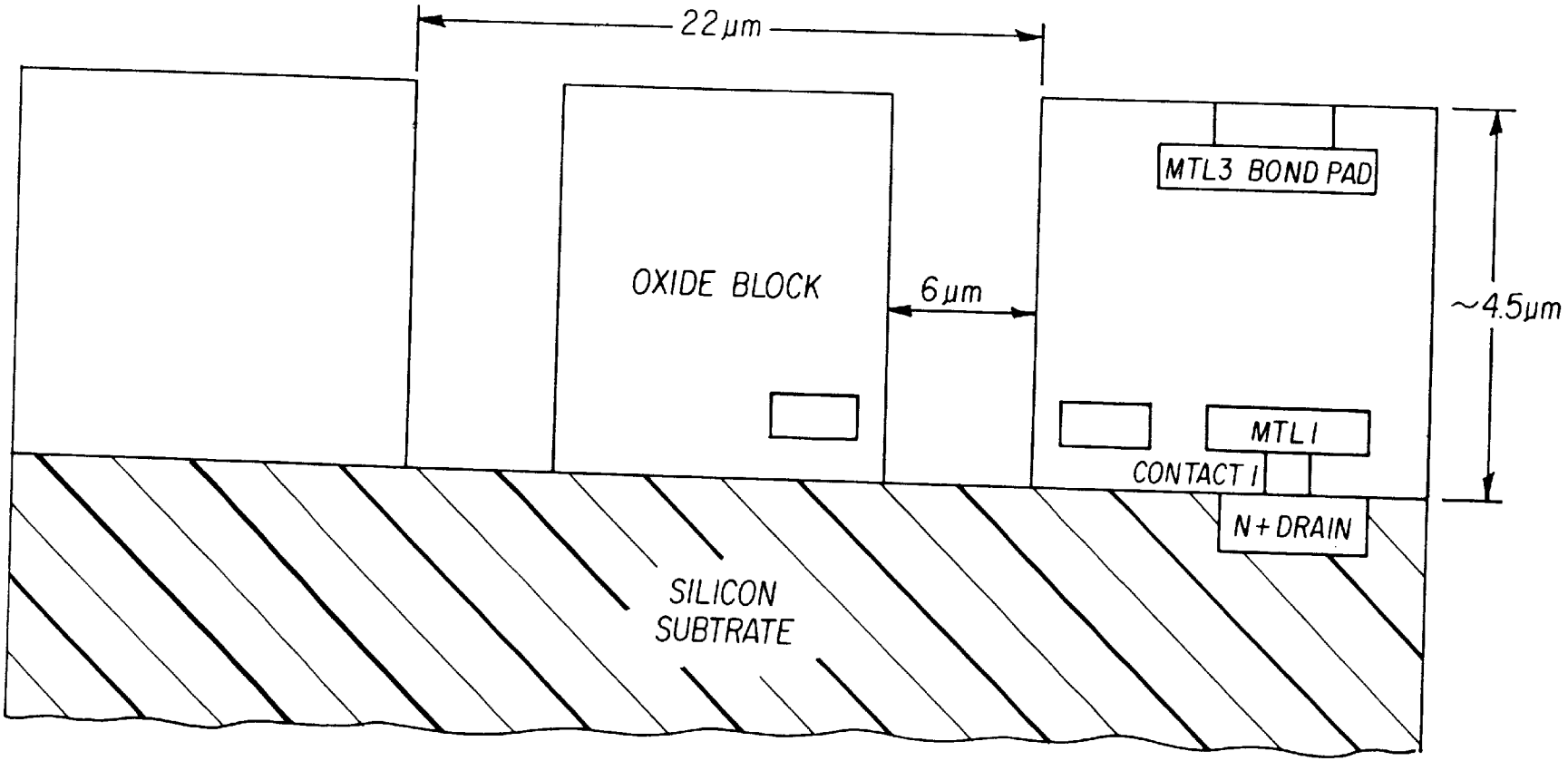
FIG. 15 is a schematic cross-sectional view taken along the line B—B in the nozzle area of FIG. 7C after the definition of an oxide block for lateral flow in accordance with the another preferred embodiment of the invention.
Figure 16:
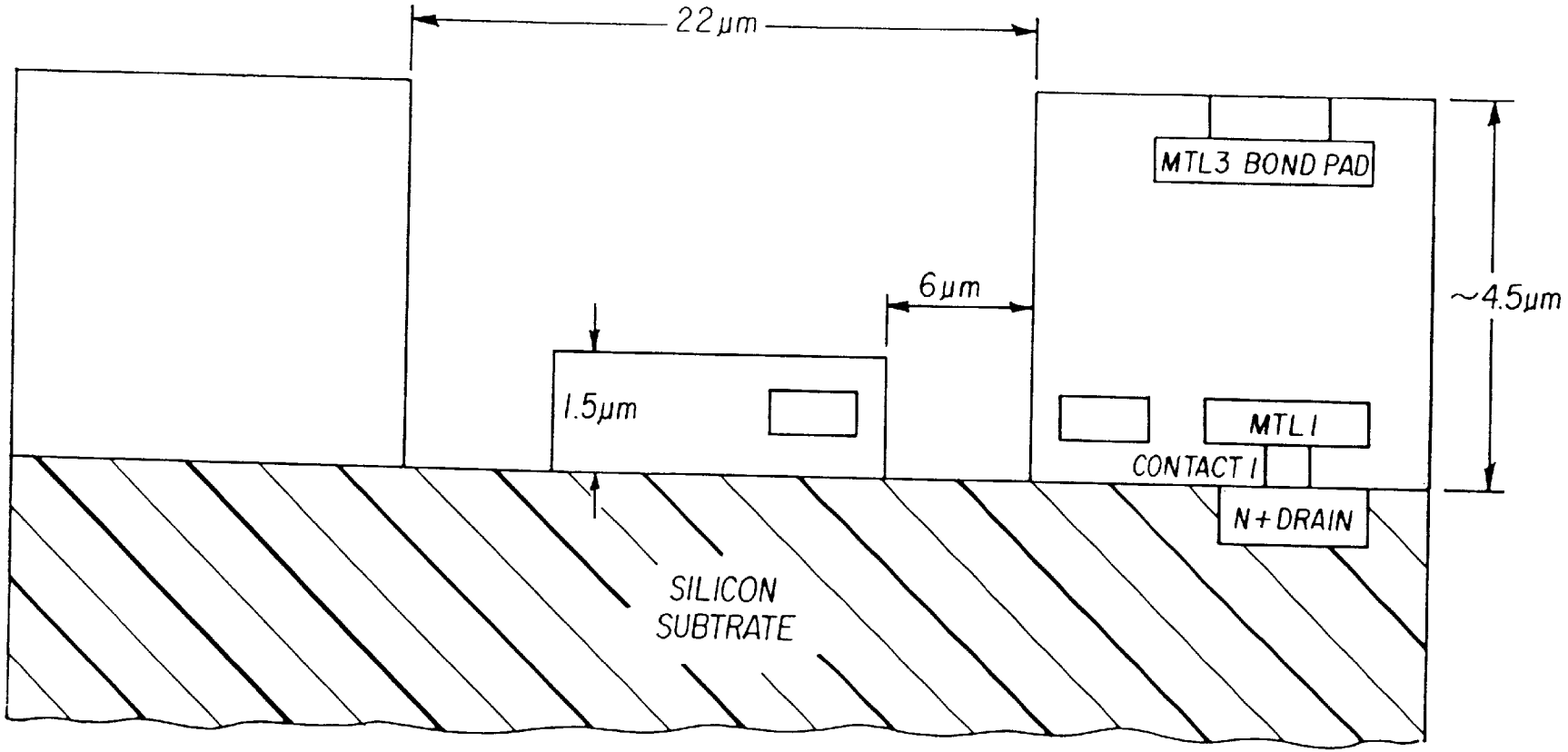
FIG. 16 is a schematic cross-sectional view taken along the line B—B in the nozzle area of FIG. 7C after the further definition of the oxide block for lateral flow.
Figure 17:
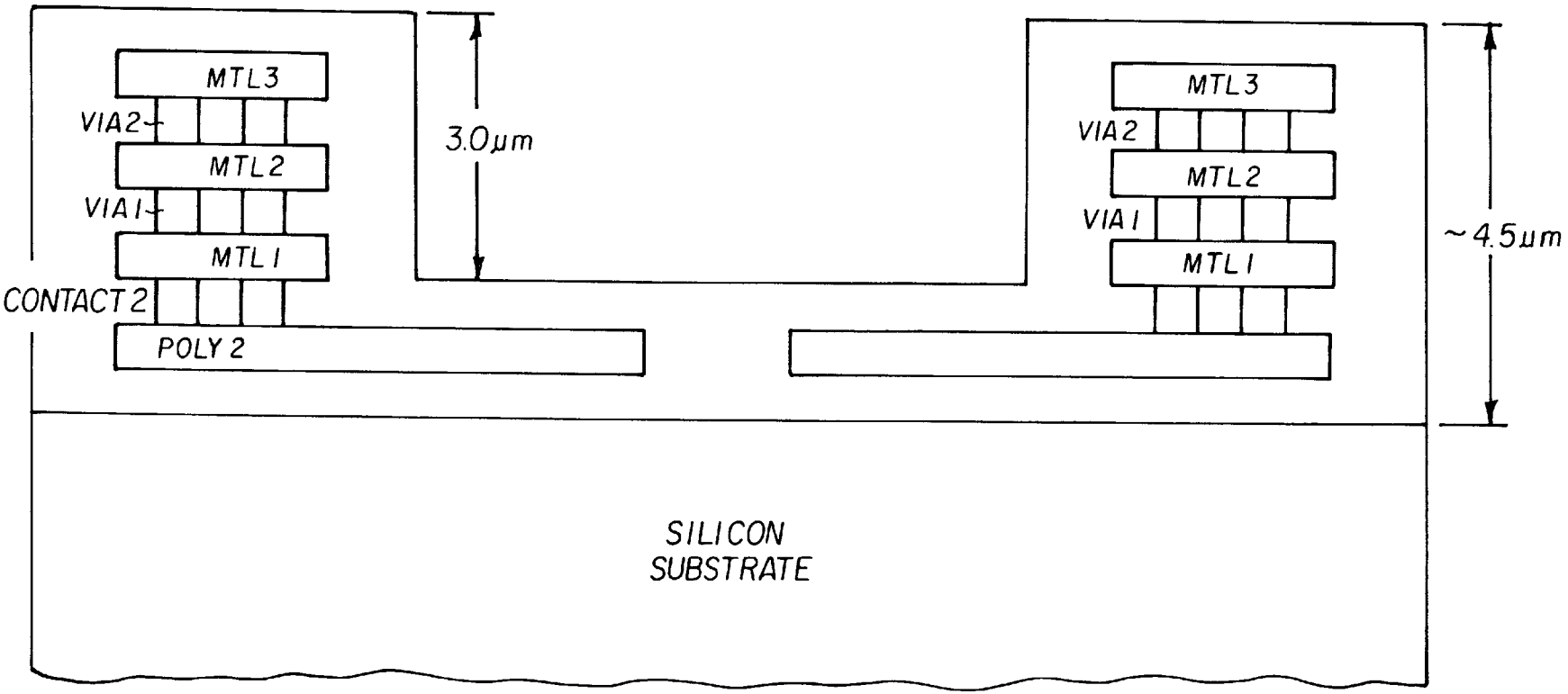
FIG. 17 is a schematic cross-sectional view taken along line A—A in the nozzle area of FIG. 7C after the definition of the oxide block for lateral flow.
Figure 18:
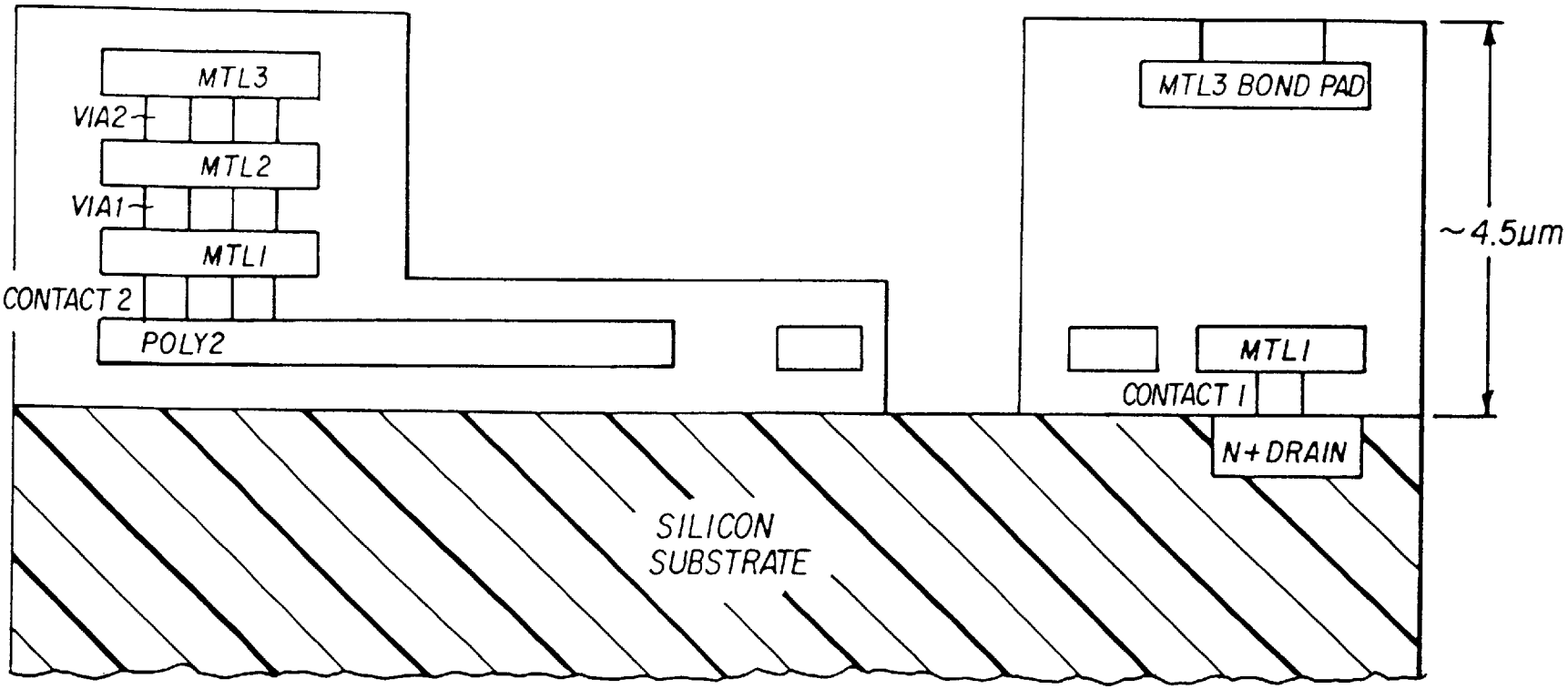
FIG. 18 is a schematic cross-sectional view taken along line A–B in the nozzle area of FIG. 7C after the definition of the oxide block used for lateral flow.

In accordance with the another embodiment of the invention, a method of constructing of a nozzle array with a ribbed structure but also featuring a lateral flow structure will now be described. With reference to FIG. 14 which as noted above shows a cross-sectional view of the silicon wafer in the vicinity of the nozzle at the end of the CMOS fabrication sequence. The first step in the post-processing sequence is to apply a mask to the front of the wafer at the region of each nozzle opening to be formed. For a particular implementation of the concept of lateral flow device, the mask is shaped so as to allow an etchant to open two 6 micrometer wide semicircular openings co-centric with the nozzle bore to be formed. The outside edges of these openings correspond to a 22 micrometers diameter circle. The dielectric layers in the semicircular regions are then etched completely to the silicon surface as shown in FIG. 15. A second mask is then applied and is of the shape to permit selective etching of the oxide block shown in FIG. 16. Upon etching, with the second mask in place, the oxide block is etched down to a final thickness or height, b, from the silicon substrate that may range from 0.5 micrometers to 3 micrometers, with a typical thickness of about 1.5 micrometers as shown in FIG. 16 for a cross-section along sectional line B—B and in FIG. 17 for a cross-section along sectional line A—A. A cross-sectional view of the nozzle area along A-B is shown in FIG. 18.

Thereafter, openings in the dielectric layer are filled with a sacrificial film such as amorphous silicon or polyimide and the wafers are planarized.

Figure 19:
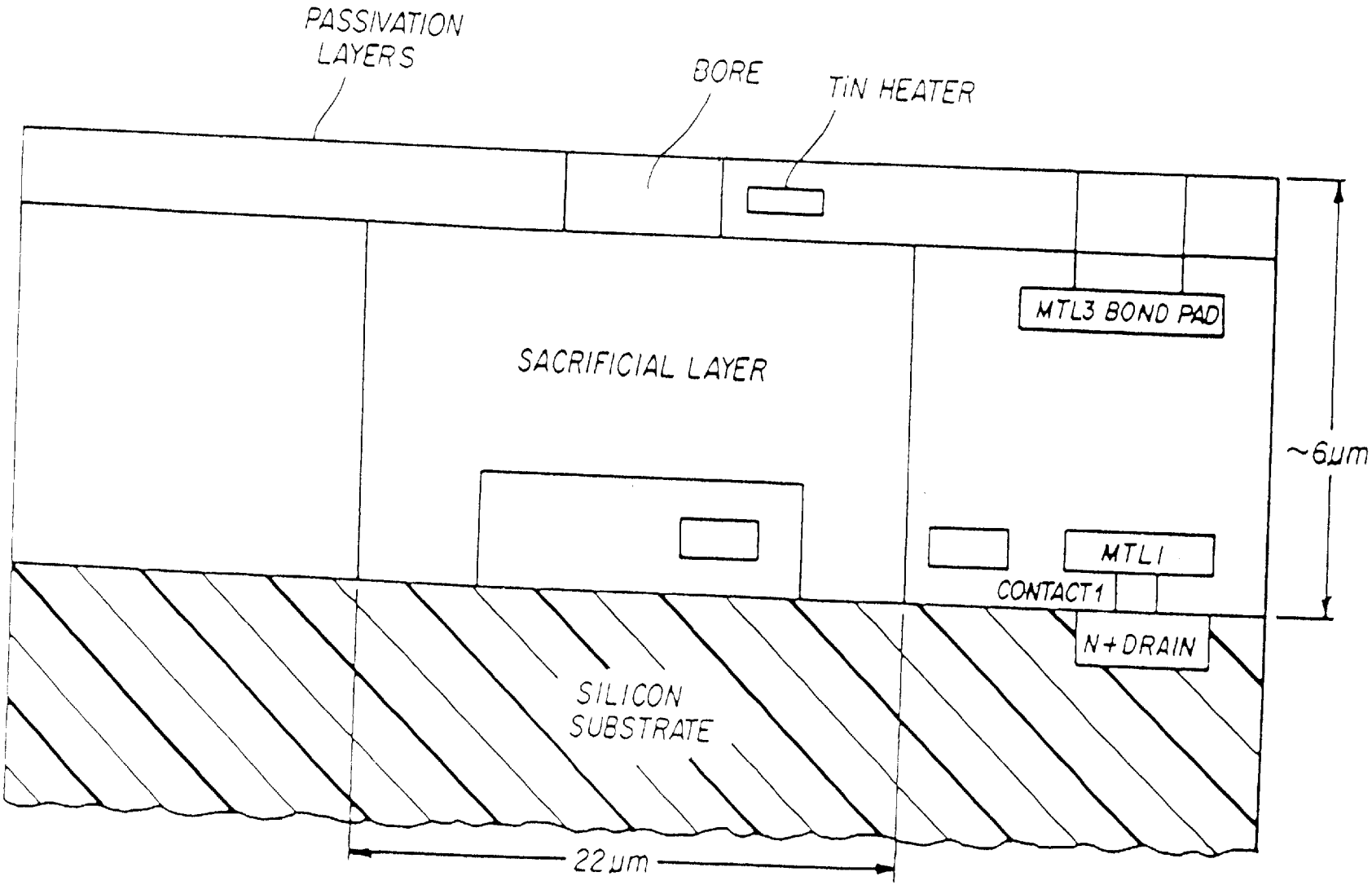
FIG. 19 is a schematic cross-sectional view taken along the B—B in the nozzle area of FIG. 7C after planarization of the sacrificial layer and deposition and definition of the passivation and heater layers and formation of the nozzle bore.
Figure 20:
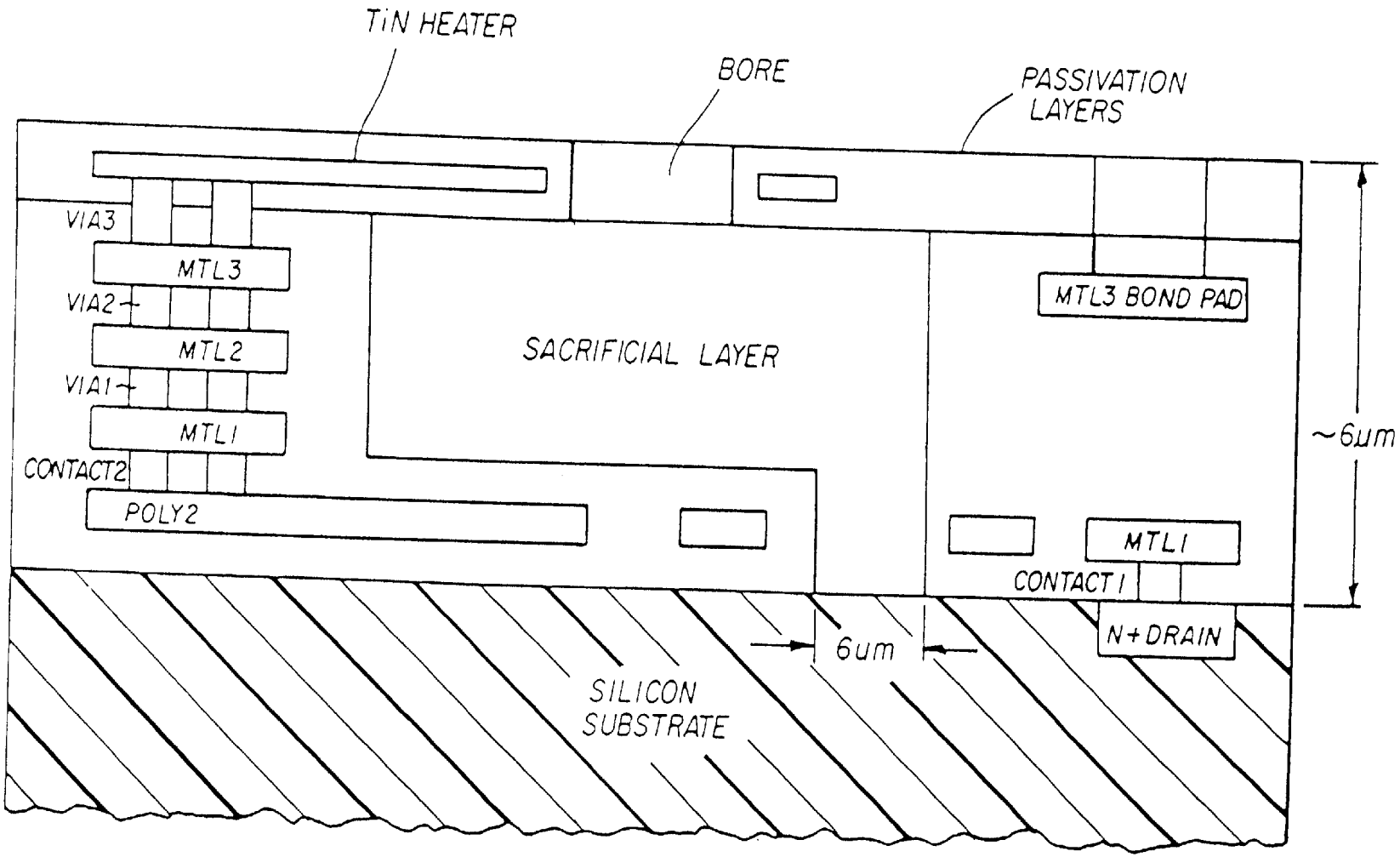
FIG. 20 is a schematic cross-sectional view taken along line A–B in the nozzle area of FIG. 7C after planarization of the sacrificial layer and deposition and definition of the passivation and heater layers and formation of the bore.

A thin, 3500 angstroms protection membrane or passivation layer, such as PECVD silicon nitride, is deposited next and then the via3's to the metal3 level (mtl3) are opened. See FIGS. 19 and 20 for reference. A thin layer of Ti/TiN is deposited next over the whole wafer followed by a much thicker W layer. The surface is then planarized in a chemical mechanical polishing process sequence that removes the W (wolfram) and Ti/TiN films from everywhere except from inside the via3's. Alternatively, the via3's can be etched with sloped sidewalls so that the heater layer, which is deposited next, can directly contact the metal3 layer. The heater layer consisting of about 50 angstroms of Ti and 600 angstroms of TiN is deposited and then patterned. A final thin protection (typically referred to as passivation) layer is deposited next. This layer must have properties that, as the one below the heater, protects the heater from the corrosive action of the ink, it must not be easily fouled by the ink and it can be cleaned easily when fouled. It also provides protection against mechanical abrasion and has the desired contact angle to the ink. To satisfy all these requirements, the passivation layer may consist of a stack of films of different materials. Similar to the embodiment discussed above, the final membrane thickness, t, encompassing the heater and the bore diameter have the dimensional characteristics described above. The thickness, t, preferably is in the range from 0.5 micrometers to 2.5 micrometers with a typical thickness of about 1.5 micrometers and the thickness is no more than 0.33 times the bore diameter, more preferably no more than 0.25 times the bore diameter and still more preferably no more than 0.15 times the bore diameter. The resulting gap, G, between the top of the oxide block and the bottom of the membrane encompassing the heater, may be in the range of 0.5 micrometers to 5 micrometers, with the typical gap being about 3 micrometers. A bore mask is applied next to the front of the wafer and the passivation layers are etched to open the bore for each nozzle and the bond pads. The bore diameters, D, may be in the range of 1 micrometer to 100 micrometers, with the preferred range being 6 micrometers to 16 micrometers. FIGS. 19 and 20 show respective cross-sectional views of each nozzle at this stage. Although only one of the bond pads is shown, it will be understood that multiple bond pads are formed in the nozzle array. The various bond pads are provided to make respective connections of data, latch clock, enable clocks, and power provided from a circuit board mounted adjacent the printhead or from a remote location.

Figure 21:
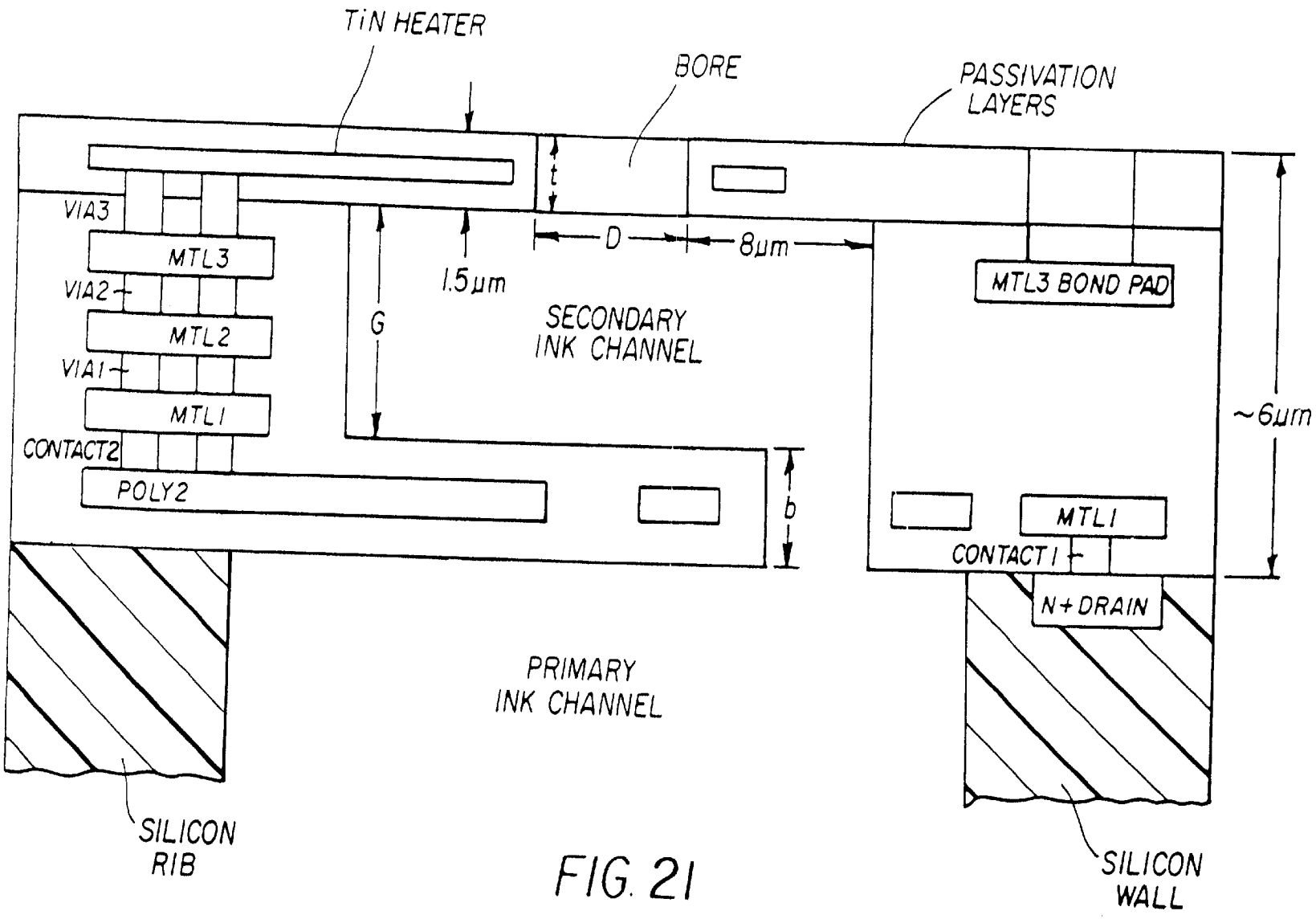
FIG. 21 is a schematic cross-sectional view taken along line A–B in the nozzle area of FIG. 7C after definition and etching of the ink channels in the silicon wafer and removal of the sacrificial layer.
Figure 24:
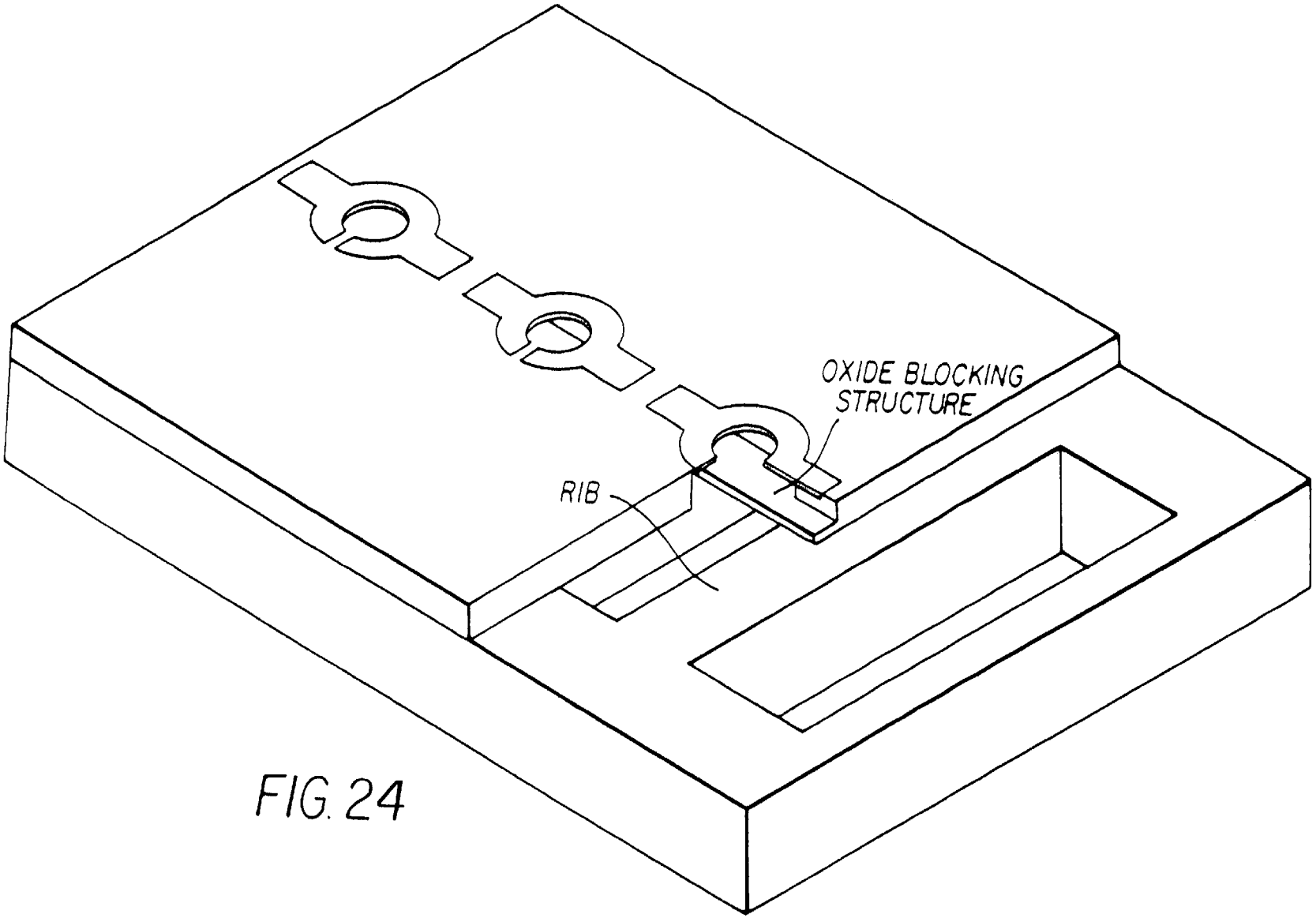
FIG. 24 is a perspective view of a portion of the CMOS/MEMS printhead with only a top heater and illustrating rib structure and an oxide blocking structure.
Figure 25:
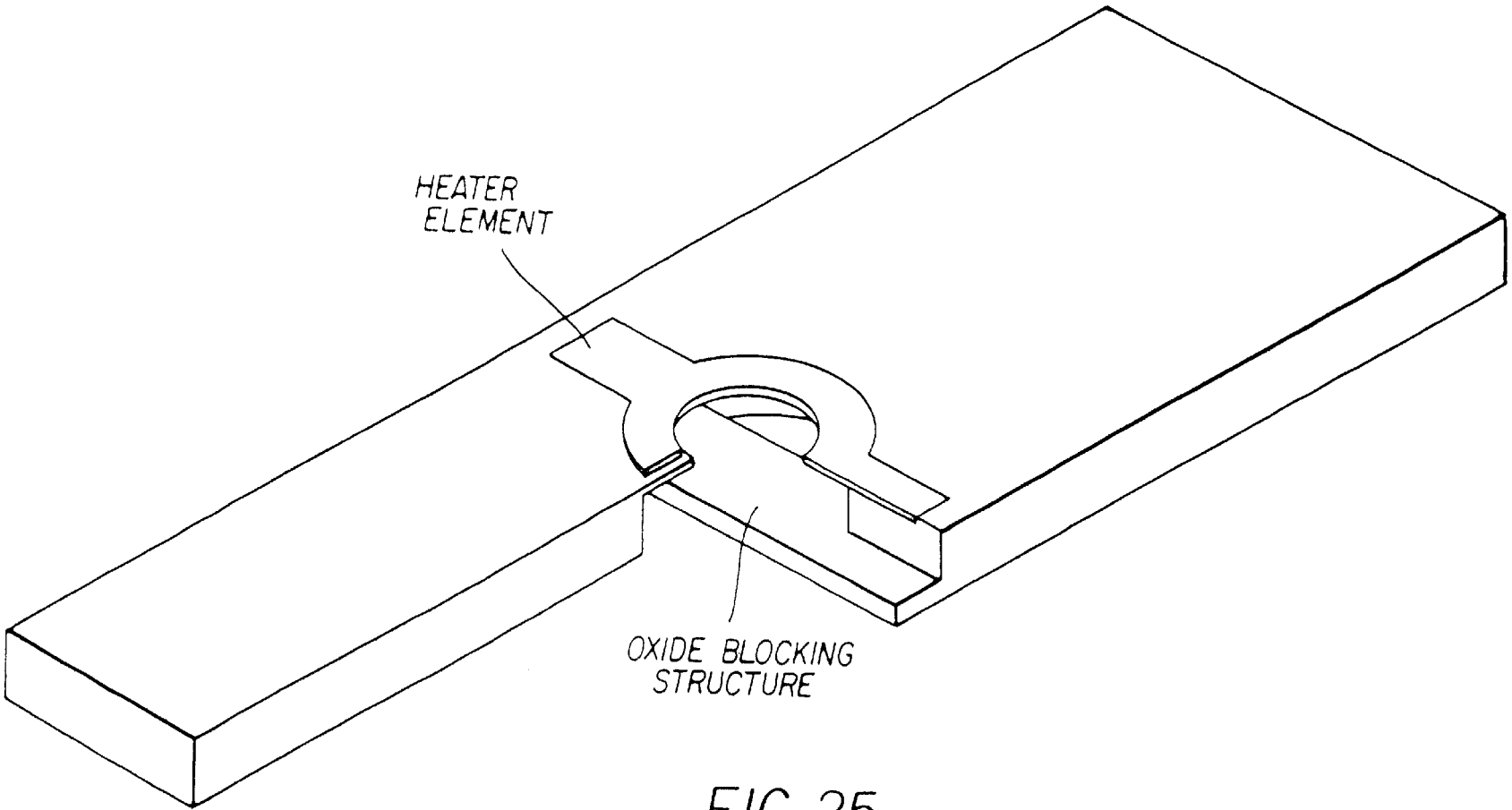
FIG. 25 is a perspective view illustrating a closer view of the oxide blocking structure.

The silicon wafer is then thinned from its initial thickness of 675 micrometers to approximately 300 micrometers. A mask to open the ink channels is then applied to the backside of the wafer and the silicon is then etched in an STS deep silicon etch system, all the way to the front surface of the silicon. Finally the sacrificial layer is etched from the backside and front side resulting in the finished device shown in FIGS. 21, 24 and 25. Alignment of the ink channel openings in the back of the wafer to the nozzle array in the front of the wafer may be provided with an aligner system such as the Karl Suss 1X aligner system.

Figure 22:
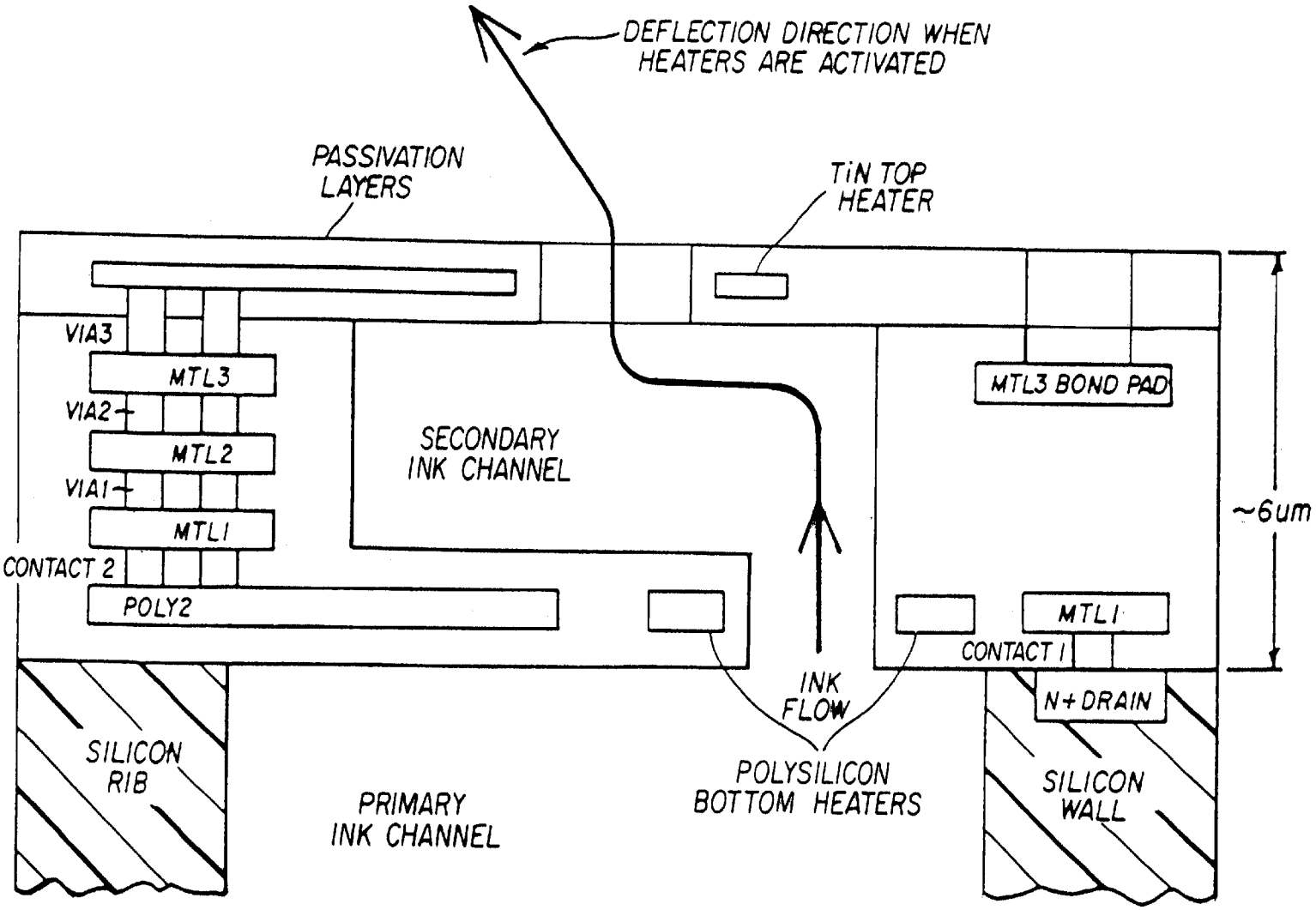
FIG. 22 is a schematic cross-sectional view taken along line A—B in the nozzle area of FIG. 7C showing top and dual bottom heaters providing lower temperature operation of the heaters and increased deflection of the jet stream.
Figure 23:
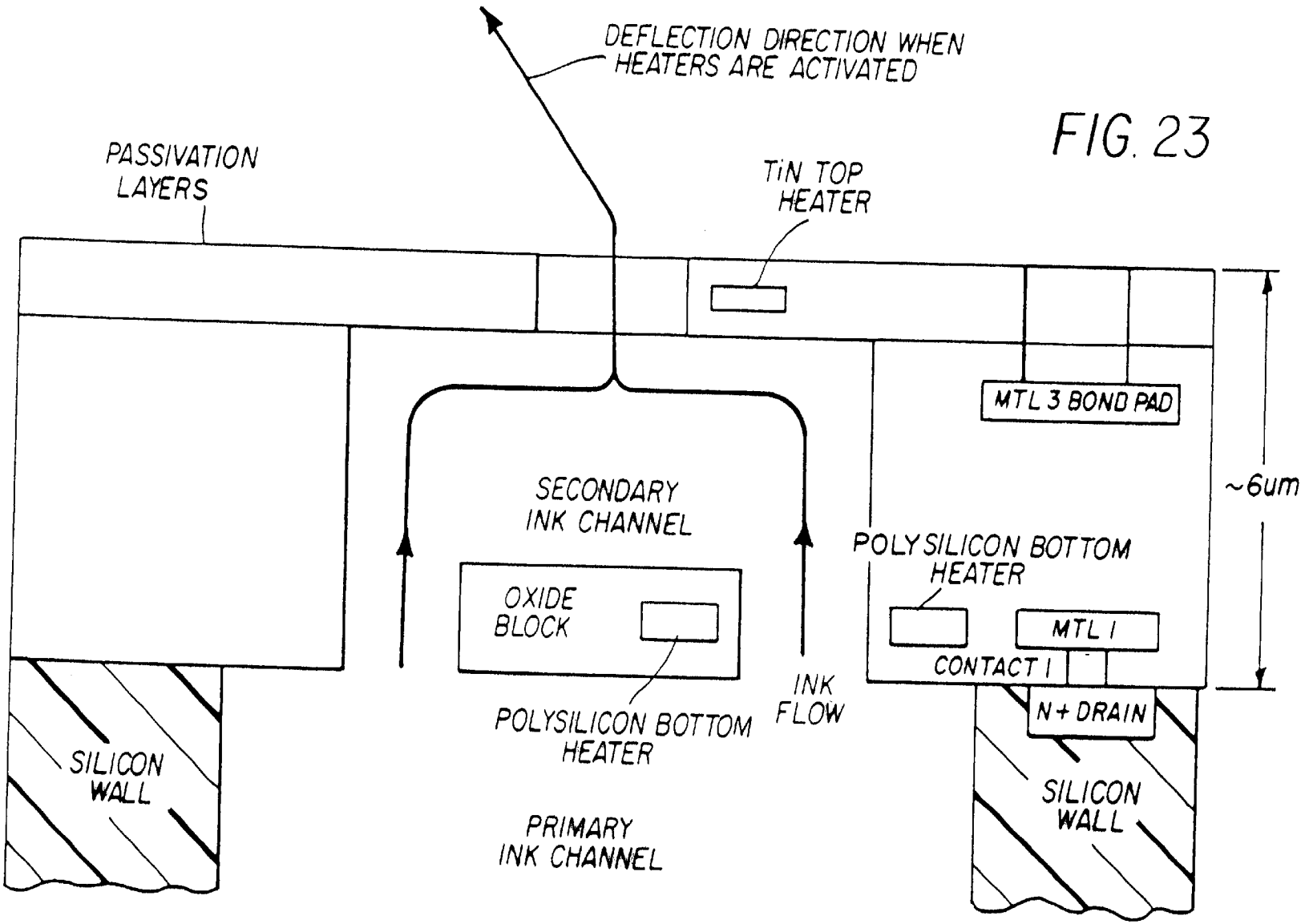
FIG. 23 is a schematic cross-sectional view similar to that of FIG. 22 but taken along line B–B of FIG. 7C.

As illustrated in FIGS. 22 and 23, the polysilicon type heater is incorporated in the bottom of the dielectric stack of each nozzle adjacent an access opening between a primary ink channel formed in the silicon substrate and a secondary ink channel formed in the oxide insulating layers. These heaters also contribute to reducing the viscosity of the ink asymmetrically. Thus as illustrated in FIG. 23, ink flow passing through the access opening at the right side of the blocking structure will be heated while ink flow passing through the access opening at the left side of the blocking structure will not be heated. This asymmetric preheating of the ink flow tends to reduce the viscosity of ink having the lateral momentum components desired for deflection and because more ink will tend to flow where the viscosity is reduced there is a greater tendency for deflection of the ink in the desired direction; i.e. away from the heating elements adjacent the bore. The polysilicon type heating elements can be of similar configuration to that of the primary heating elements adjacent the bore. Where heaters are used at both the top and the bottom of each nozzle bore, as illustrated in these figures, the temperature at which each individual heater operates can be reduced dramatically. The reliability of the TiN heaters is much improved when they are allowed to operate at temperatures well below their annealing temperature. The lateral flow structure made using the oxide block allows the location of the oxide block to be aligned to within 0.02 micrometers relative to the nozzle bore.

As shown schematically in FIG. 23, the ink flowing into the bore is dominated by lateral momentum components, which is what is desired for increased droplet deflection.

It is preferred to have etching of the silicon substrate be made to leave behind a silicon bridge or rib between each nozzle of the nozzle array during the etching of the ink channel. These bridges extend all the way from the back of the silicon wafer to the front of the silicon wafer. The ink channel pattern defined in the back of the wafer, therefore, is a series of small rectangular cavities each feeding a single nozzle. The ink cavities may be considered to each comprise a primary ink channel formed in the silicon substrate and a secondary ink channel formed in the oxide/nitride layers with the primary and secondary ink channels communicating through an access opening established in the oxide/nitride layer. These access openings require ink to flow under pressure between the primary and secondary channels and develop lateral flow components because direct axial access to the secondary ink channel is effectively blocked by the oxide block. The secondary ink channel communicates with the nozzle bore.

Figure 26:
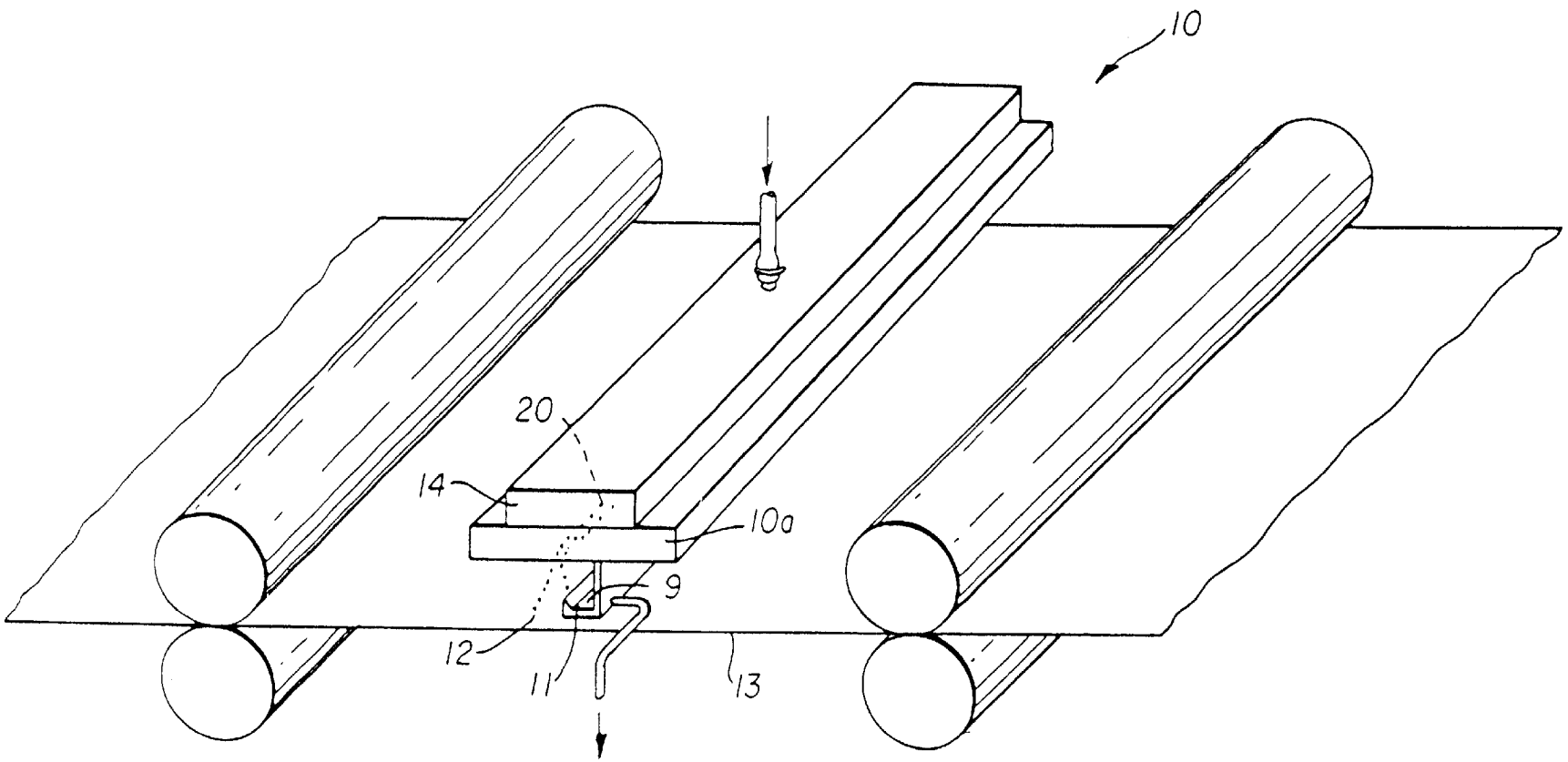
FIG. 26 is a perspective view of the CMOS/MEMS printhead formed in accordance with the invention and mounted on a supporting member into which ink is delivered.

With reference to FIG. 26 in the completed CMOS/MEMS printhead 120 corresponding to any of the embodiments described herein is mounted on a supporting mount 110 having a pair of ink feed lines 130L, 130R connected adjacent end portions of the mount for feeding ink to ends of a longitudinally extending channel formed in the supporting mount. The channel faces the rear of the printhead 120 and is thus in communication with the array of ink channels formed in the silicon substrate of the printhead 120. The supporting mount, which could be a ceramic substrate, includes mounting holes at the ends for attachment of this structure to a printer system.

There has thus been described an improved ink jet printhead and methods of operating and forming same. The ink jet printheads are characterized by relative ease of manufacture and/or with relatively planar surfaces to facilitate cleaning and maintenance of the printhead and a relatively thin insulating layer or layers, such as a passivation layer or layers, through which is formed the nozzle bore. Adjacent each nozzle bore is an appropriate asymmetric heating element. While not essential to the invention, the printheads described herein are suited for preparation in a conventional CMOS facility and the heater elements and channels and nozzle bore may be formed in a conventional MEMS facility. As noted above the provision of a simple thin membrane through which the exit orifice is formed provides for a continuous ink jet printer that exhibits a significant improvement in performance.

Although the present invention has been described with particular reference to various preferred embodiments, the invention is not limited to the details thereof. Various substitutions and modifications will occur to those of ordinary skill in the art, and all such substitutions and modifications are intended to fall within the scope of the invention as defined in the appended claims.

The invention has been described in detail with particular reference to certain preferred embodiments thereof, but it will be understood that variations and modifications can be effected within the spirit and scope of the invention.

PARTS LIST

10 image source
12 image-processing unit
14 heater control circuits
16 printhead
17 ink gutter
18 recording medium
19 ink recycling unit
20 recording medium transport system
22 recording medium transport control system
24 micro-controller
26 ink pressure regulator
28 ink reservoir
30 ink channel device
40 ink delivery channel
42 substrate
46 nozzle bore
46*a* tapered exit region
50 nozzle heaters
56 insulating layer
60 stream
64 thin film layer
66 drops
67 undeflected drop in line
68 nozzle plate
70 ink
80*a*, 80*b* substrate
82*a*, 82*b* oxide layer
84*a*, 84*b* nozzle openings
90*a*, 90*b* substrate
92*a*, 92*b* oxynitride
94*a*, 94*b* orifice
96*a*, 96*b* ink channel

What is claimed is:

1. A continuous ink jet printhead comprising:

a substrate including an ink delivery channel having ink under pressure in a relief portion formed in the substrate, a thin membrane that comprises an overhang from the relief portion of the substrate, the thin membrane being substantially thinner than a thickness of the substrate and the overhang extending from the relief portion with a dimension OH;

a nozzle bore which opens into the ink delivery channel to establish a continuous flow of ink in a stream from the nozzle bore, the nozzle bore being formed in the thin membrane at the overhang and having an exit opening with a respective diameter dimension, D;

a heater adjacent the nozzle bore, the heater adapted to produce asymmetric heating to the stream of ink to control direction of the stream between a print direction and a non-print direction; and the nozzle bore being characterized by a dimensional relationship wherein the overhang dimension OH is related to the diameter dimension of the exit opening so that OH>=½ D; and wherein thickness, t, of the membrane within which the nozzle bore is formed is related to the diameter dimension of the exit opening so that t<=0.33D.

2. The ink jet printhead of claim 1 and wherein:

the substrate is formed of silicon and includes an integrated circuit formed therein for controlling operation of the printhead, the silicon substrate having one or more ink channels formed therein;

an insulating layer or layers overlies the silicon substrate, the insulating layer or layers having a series of ink jet nozzle bores, each nozzle bore being formed in a respective thin membrane of thickness t and overhang dimension OH and diameter dimension D, the dimensions t, D and OH having said dimensional relationship, the nozzle bores being formed along the length of the substrate and forming a generally planar surface and each bore communicates with an ink channel; and a respective heater is associated with each nozzle bore and is located proximate a respective nozzle bore for asymmetrically heating ink as it passes through the nozzle bore.

3. The ink jet printhead of claim 2 wherein the insulating layer or layers includes a series of vertically separated levels of electrically conductive leads and electrically conductive vias connect at least some of said levels.

4. The ink jet printhead of claim 3 wherein the bores are each formed in a passivation layer or layers and the heater is covered by the passivation layer or layers.

5. The ink jet printhead of claim 4 wherein the heaters each comprise a circular heater element having a notch formed therein.

6. The ink jet printhead of claim 5 and wherein a secondary heater element is provided in the insulating layer or layers adjacent the ink channel and positioned to preheat ink prior to the ink entering the nozzle bore.

7. The ink jet printhead of claim 6 wherein a blocking structure is formed in the insulating layer or layers just below the nozzle bore and an access opening is provided for allowing ink to flow about the blocking structure to establish lateral momentum components in the ink flowing about the blocking structure prior to ink entering the nozzle bore.

8. The ink jet printhead of claim 7 and including a gutter for catching ink droplets not selected for printing.

9. The ink jet print printhead of claim 8 and wherein the integrated circuit is formed of CMOS devices and the insulating layer or layers includes an element that forms a gate of a CMOS transistor.

10. The ink jet printhead of claim 4 wherein the heater and the passivation layer or layers which cover the heater extend over the ink channel formed in the insulating layer.

11. The ink jet printhead of claim 2 and wherein the heater is supported over the ink channel in the insulating layer or layers.

12. The ink jet printhead of claim 11 and wherein the thickness of the thin membrane which defines the thickness of the nozzle bore is in the range of about 0.5 micrometers to about 2.5 micrometers.

13. The ink jet printhead of claim 12 and wherein the nozzle bore has a diameter in the range of 6 micrometers to 16 micrometers.

14. The ink jet printhead of claim 13 and wherein a secondary heater is provided in the insulating layer or layers adjacent the ink channel and positioned to preheat ink prior to the ink entering the nozzle bore.

15. The ink jet printhead of claim 1 and wherein the thickness of the thin membrane which defines the thickness of the nozzle bore is in the range of 0.5 micrometers to 6 micrometers.

16. The ink jet printhead of claim 1 and wherein the thickness of the thin membrane which defines the thickness of the nozzle bore is in the range of about 0.5 micrometers to about 2.5 micrometers.

17. The ink jet printhead of claim 16 and wherein the nozzle bore has a diameter in the range of 6 micrometers to 16 micrometers.

18. The ink jet printhead of claim 17 and wherein a blocking structure is formed in the ink channel and located just below the nozzle bore and there is provided an access opening for ink to flow about the blocking structure to establish lateral momentum components to the ink flowing about the blocking structure prior to ink entering the nozzle bore.

19. The ink jet printhead of claim 18 and wherein the thickness of the blocking structure is in the range of 0.5 micrometers to 3 micrometers.

20. The ink jet printhead of claim 18 and wherein the blocking structure is about 1.5 micrometers in thickness.

21. The ink jet printhead of claim 1 and wherein a blocking structure is formed in the ink channel just below the thin membrane layers and an access opening is provided to allow ink to flow about the blocking structure to establish lateral momentum components in the ink prior to ink entering the nozzle bore.

22. The ink jet printhead of claim 21 and wherein the blocking structure has a thickness in the range of 0.5 micrometers to 3 micrometers and a gap between the top of the blocking structure and the bottom of the thin membrane is in the range of 0.5 to 5 micrometers.

23. The ink jet printhead of claim 22 and wherein the thickness of the thin membrane which defines the thickness of the bore is in the range of 0.5 micrometers to 6 micrometers and wherein the nozzle bore has a diameter in the range of 6 micrometers to 16 micrometers.

24. The ink jet printhead of claim 23 and including a gutter for catching ink drops not selected for printing.

25. The ink jet printhead of claim 1 and including a gutter for catching ink drops not selected for printing.

26. The ink jet printhead of claim 25 wherein the nozzle bore has a diameter in the range of 1 micrometer to 100 micrometers.

27. The ink jet printhead of claim 1 and wherein $t<=0.25D$.

28. The ink jet printhead of claim 1 and wherein $t<=0.15D$.

29. The ink jet printhead of claim 28 and wherein the nozzle bore has a diameter in the range of 1 micrometer to 100 micrometers.

30. The ink jet printhead of claim 28 and wherein the nozzle bore has a diameter in the range of 6 micrometers to 16 micrometers.

31. The ink jet printhead of claim 30 and wherein the thickness of the thin membrane which defines the thickness of the nozzle bore is in the range of about 0.5 micrometers to about 2.5 micrometers.

32. A method of operating a continuous ink jet printhead comprising:

providing a substrate having plural ink delivery channels formed therein each channel terminating at a respective nozzle bore, each nozzle bore being formed in a thin membrane that comprises an overhang from a relief portion of the substrate, the thin membrane being substantially thinner than the thickness of the substrate and the overhang extending from the relief portion with a dimension OH, the nozzle bore having a respective diameter dimension D, and the thin membrane having a thickness t, and wherein the overhang dimension is related to the diameter dimension so that $OH>=\frac{1}{2} D$ and wherein $t<=0.33D$; moving ink under pressure from the ink delivery channels formed in the substrate to each of the nozzle bores to cause ink to flow continuously from the nozzle bores; and selectively effecting collection of certain ink droplets in collection devices associated with the nozzle bores so that ink droplets not collected by the collection devices form a predetermined image on a receiver sheet.

33. The method of claim 32 and wherein a heater is provided adjacent each nozzle bore and selective activation of each heater is provided to selectively determine which ink droplets are collected in the collection devices.

34. The method of claim 33 and wherein the heater asymmetrically heats ink in the nozzle bore to cause ink to be selectively deflected.

35. The method of claim 34 and wherein the nozzle bore has a diameter in the range of 6 micrometers to 16 micrometers.

36. The method of claim 35 and wherein the ink droplets are deflected from a nozzle bore at a deflection angle of between about 3 degrees to about 10 degrees, the deflection angle being defined as a line connecting the deflected droplets to the center of the nozzle bore in the printhead and a line normal to a plane of the printhead and through a middle of the nozzle bore.

37. The method of claim 34 and wherein ink flows about a blocking structure axially aligned with the nozzle bore; and ink flow, because of flow about such structure, is provided with lateral momentum components prior to entering the nozzle bore.

38. The method of claim 32 and wherein the thickness of the thin membrane which defines the thickness of the nozzle bore is in the range of 0.5 micrometers to 6 micrometers.

39. The method of claim 32 and wherein the thickness of the thin membrane which defines the thickness of the nozzle bore is in the range of about 0.5 micrometers to about 2.5 micrometers.

40. The method of claim 32 and wherein the ink is preheated by a heating element located below the nozzle bore and before the ink enters the nozzle bore.

41. The method of claim 32 wherein the nozzle bore has a diameter in the range of 1 micrometer to 100 micrometers.

42. The method of claim 32 and wherein $t<=0.25D$.

43. The method of claim 32 and wherein $t<=0.15D$.

44. The method of claim 43 and wherein the nozzle bore has a diameter in the range of 6 micrometers to 16 micrometers.

45. The method of claim 32 and wherein the thickness of the thin membrane which defines the thickness of the nozzle bore is in the range of about 0.5 micrometers to about 2.5 micrometers.

46. A continuous ink jet printhead comprising a nozzle bore formed in a thin membrane that overhangs from a relief portion of a substrate, the thin membrane being of thickness t to define the thickness of the nozzle bore and the nozzle bore being spaced from the relief portion of the substrate with a dimension OH, the nozzle bore having a respective diameter dimension D and characterized in that $OH>=\frac{1}{2} D$; and wherein $t<=0.33D$.

47. The ink jet printhead of claim 46 and including a gutter for catching ink droplets not selected for printing.

48. The ink jet printhead of claim 47 and wherein the nozzle bore has a diameter in the range of 6 micrometers to 16 micrometers.

49. The ink jet printhead of claim 47 and wherein t is in the range of about 0.5 micrometers to about 2.5 micrometers.

50. The ink jet printhead of claim 49 and wherein the nozzle bore has a diameter in the range of 6 micrometers to 16 micrometers.

* * * * *